US005637966A

United States Patent [19]

Umstadter et al.

[11] Patent Number: 5,637,966

[45] Date of Patent: Jun. 10, 1997

[54] METHOD FOR GENERATING A PLASMA WAVE TO ACCELERATE ELECTRONS

[75] Inventors: Donald Umstadter, Ann Arbor, Mich.; Eric Esarey, Chevy Chase, Md.; Joon K. Kim, Ann Arbor, Mich.

[73] Assignee: The Regents of the University of Michigan, Ann Arbor, Mich.

[21] Appl. No.: 384,154

[22] Filed: Feb. 6, 1995

[51] Int. Cl.[6] ..... H01J 23/00

[52] U.S. Cl. ..... 315/507; 315/500; 315/505; 315/111.81; 359/342

[58] Field of Search ..... 315/500, 505, 315/507, 111.81; 359/342

[56] References Cited

U.S. PATENT DOCUMENTS

| | | | |
|---|---|---|---|
| 4,655,547 | 4/1987 | Heritage et al. | 350/162.12 |
| 4,764,930 | 8/1988 | Bille et al. | 372/23 |
| 4,875,213 | 10/1989 | Lo | 372/5 |
| 4,910,746 | 3/1990 | Nicholson | 372/68 |
| 4,928,316 | 5/1990 | Heritage et al. | 455/600 |
| 4,937,532 | 6/1990 | Dawson et al. | 315/505 |
| 5,235,606 | 8/1993 | Mourou et al. | 372/72 |
| 5,353,291 | 10/1994 | Sprangle et al. | 372/5 |

OTHER PUBLICATIONS

T. Tajima and J.M. Dawson, "Laser Beat Accelerator", IEEE Transactions on Nuclear Science, vol. NS–28, No. 3, 3416–3417, Jun. 1981.

L.M. Gorbunov and V.I. Kirsanov, "Excitation of Plasma Waves by an Electromagnetic Wave Packet", Sov. Phys. JETP, vol. 66, No. 2, 290–294, Aug. 1987.

P. Sprangle, E. Esarey, A. Ting, and G. Joyce, "Laser Wakefield Acceleration and Relativistic Optical Guiding", Appl. Phys. Lett., vol. 53, No. 22, 2146–2148, Nov. 28, 1988.

T. Tajima and J.M. Dawson, "An Electron Accelerator Using a Laser", IEEE Transactions on Nuclear Science, vol. NS–26, No. 3, 4188–4189, Jun. 1979.

T. Tajima and J.M. Dawson, "Laser Electron Accelerator", Physical Review Letters, vol. 43, No. 4, 267–270, Jul. 23, 1979.

S.V. Bulanov, V.I. Kirsanov, and A.S. Sakharov, "Excitation of Ultrarelativistic Plasma Waves by Pulse of Electromagnetic Radiation", American Institute of Physics JETP Lett., Vo. 50, No. 4, 198–201, Aug. 25, 1989.

P. Sprangle, E. Esarey, and A. Ting, "Nonlinear Interaction of Intense Laser Pulses in Plasmas", Physical Review A, vol. 41, No. 8, 4463–4469, Apr. 15, 1990.

J. Squier, F. Salin, and G. Mourou, "100–fs Pulse Generation and Amplification in Ti:A1203", Otics Letters, vol. 16, No. 6, 324–326, Mar. 1991.

(List continued on next page.)

*Primary Examiner*—Robert Pascal
*Assistant Examiner*—Michael Shingleton
*Attorney, Agent, or Firm*—Barnes, Kisselle, Raisch, Choate, Whittemore & Hulbert, PC

[57] ABSTRACT

The invention provides a method and apparatus for generating large amplitude nonlinear plasma waves, driven by an optimized train of independently adjustable, intense laser pulses. In the method, optimal pulse widths, interpulse spacing, and intensity profiles of each pulse are determined for each pulse in a series of pulses. A resonant region of the plasma wave phase space is found where the plasma wave is driven most efficiently by the laser pulses. The accelerator system of the invention comprises several parts: the laser system, with its pulse-shaping subsystem; the electron gun system, also called beam source, which preferably comprises photo cathode electron source and RF-LINAC accelerator; electron photo-cathode triggering system; the electron diagnostics; and the feedback system between the electron diagnostics and the laser system. The system also includes plasma source including vacuum chamber, magnetic lens, and magnetic field means. The laser system produces a train of pulses that has been optimized to maximize the axial electric field amplitude of the plasma wave, and thus the electron acceleration, using the method of the invention.

49 Claims, 8 Drawing Sheets

OTHER PUBLICATIONS

V.I. Berezhiani and I.G. Murusidze, "Interaction of Highly Relativistic Short Laser Pulses with Plasmas and Nonlinear Wakefield Generation", Physica Scripta 45, 87–90, 1991.

J. Squier and G. Mourou, "Tunable SolidState Lasers Create Ultrashort Pulses", Laser Focus World, Jun. 1992.

D.H. Reitze, A.M. Weiner, and D.E. Leaird, "Shaping of Wide Bandwidth 20 Femtosecond Optical Pulses", Appl. Phys. Lett., vol. 61, No. 11, 1260–1262, Sep. 14, 1992.

D. Umstadter, E. Esarey, J. Kim, "Nonlinear Plasma Waves Resonantly Driven by Optimized Laser Pulse Trains", Physical Review Letters, vol. 72, No. 8, 1224–1227, Feb. 21, 1994.

H.C. Kapteyn and M.M. Murnane, "Femtosecond Lasers: The Next Generation", Optics & Photonics News, 20–28, Mar. 1994.

D. Umstadter, J. Kim, E. Esarey, E. Dodd, and T. Neubert, "Resonantly Laser–Driven Plasma Waves for Electron Acceleration", Physical Review E, vol. 51, No. 4, 3484–3497, Apr. 1995.

T. Tajima and J.M. Dawson , "Laser Accelerator by Plasma Waves", Unpublished.

METHOD FOR GENERATING A PLASMA WAVE TO ACCELERATE ELECTRONS

FIELD OF THE INVENTION

This invention relates to a method and apparatus for exciting plasma waves in a plasma, by means of laser, in order to accelerate particles.

GOVERNMENT RIGHTS

This invention was made with government support provided by the National Science Foundation, the Office of Naval Research, and the Department of Energy. The government has certain rights in the invention.

BACKGROUND OF THE INVENTION

The generation of large amplitude, relativistic plasma waves is a subject of much current interest because of its potential use for ultrahigh-gradient electron acceleration.

There are two other major types of laser driven, plasma based accelerators: the plasma beatwave accelerator (PBWA) and the laser wakefield accelerator (LWFA). While advanced RF-driven accelerators are limited to fields $\leqq 1$ MV/cm, plasma accelerators have been shown experimentally to support gradients ~10 MV/cm. The maximum axial electric field of a relativistic plasma wave, as predicated by 1-D cold fluid theory, is the "wave breaking" field: $E_{WB}=(m_e c w_p/e)\sqrt{2(\gamma_{p-1})}$, which can exceed 1 GV/cm, where $w_p=(4\pi^{2n}{}_{eO}/m_e)^{1/2}$ is the electron plasma frequency, $n_{eO}$ is the ambient electron density, $\gamma_p=(1-v_p{}^2/c^2)^{-1/2}$ and $v_p$ is the phase velocity of the plasma wave.

In the PBWA, two laser beams of frequencies w and $w-w_p$ are optically mixed in a plasma to produce a laser beatwave, in effect a train of equally spaced pulses, which "resonantly" excites a large amplitude plasma wave. A fundamental limitation to the plasma wave amplitude in the PBWA is resonant detuning. As the plasma wave amplitude grows, nonlinear effects cause the resonant frequency to shift away from $w_p$, which leads to saturation and thus limits the plasma wave amplitude. In the LWFA, a single, intense, short laser pulse drives a plasma wave "wakefield". The maximum plasma wave amplitude results when $\tau \sim 2\pi/w_p$, where $\tau$ is the laser pulse width, which translates into a "resonant density", since $w_p \sim n_{eO}{}^{1/2}$. Recently, the self-modulated LWFA has been suggested. Here, a single laser pulse is incident on a plasma with a density that is higher than the "resonant density". Due to a self-modulation instability, the pulse breaks up into multiple pulses, each of which are "resonant". Although higher plasma densities and the multiple pulse structure lead to higher wakefield amplitudes, both high plasma densities and high laser intensities are difficult to achieve simultaneously due to plasma defocusing, and electron acceleration is limited by phase detuning, i.e., accelerated electrons (with $v \rightarrow c$) outrun the plasma wave (with $v_p \approx v_g < c$).

SUMMARY OF THE INVENTION

The invention provides a method and apparatus for generating large amplitude nonlinear plasma waves, driven by an optimized train of independently adjustable, intense laser pulses. In the method, optimal pulse widths, and interpulse spacing, and intensity profiles of each pulse are determined for a series of a finite number (n) of laser pulses. The terms "pulse train", "train of pulses", "series of pulses", and "pulse series" are used interchangeably. The terms "ions" and "charged particles" are also used interchangeably. A resonant region of the plasma wave phase space is found where the plasma wave is driven most efficiently by the laser pulses. In one embodiment, the width of this region, and thus the optimal finite rise time laser pulse width decreases with increasing background plasma density and plasma wave amplitude, while the nonlinear plasma wave length, and thus the optimal interpulse spacing, increases. Accordingly, the pulse widths, interpulse spacing, and intensity profiles are optimized by the method so that resonance is maintained between the laser pulses and the plasma wave, so that the axial electric field amplitude, of the plasma wave is maximized.

The new method, referred to as resonant laser-plasma accelerator (RLPA) synchronizes the laser pulse with the accelerated electrons. This results in several advantages. By utilizing a train of laser pulses with independently adjustable pulse widths, interpulse spacings, and intensity profiles, which are varied in an optimized manner, resonance with both the changing plasma wave period and resonance width can be maintained in the nonlinear regime, and the maximum plasma wave amplitude is achieved; lower plasma densities can be used, thus avoiding electron phase detuning; and lower peak laser intensities can be used, thus allowing for a reduction of laser-plasma instabilities.

The resonant laser-plasma accelerator (RLPA) comprises a laser system; an electron beam source (or injector); a plasma source; an optical transport system; and an electron beam transport system. The laser system is based on the technique of chirped pulse amplification (CPA), which is capable of generating a series of ultra short, ultrahigh intensity pulses. Ultra short pulses are generally considered to be those which are nanosecond duration or less, and typically picosecond and femtosecond. Ultrahigh intensity pulses are considered to be those in excess of $10^{15}$ W/cm$^2$, and CPA systems routinely deliver intensities on the order of $10^{18}$ W/cm$^2$. CPA laser systems which deliver one or more ultrashort, ultrahigh intensity pulses are in various stages of development. These laser systems are modified in the method of the invention to deliver a series of pulses by one or two methods, namely, using amplitude and phase masks in the stretcher portion of the CPA system, or a separate zero dispersion stretcher system inserted in front of the regular stretcher of the CPA system; or using beamsplitters to produce several amplified stretch pulses in conjunction with several separate compressors and delay lines.

An electron beam source (or injector) is one which is capable of generating a series of ultrashort electron bunches at modest energies, in the range of, for example, 1 to 50 MeV. Desirably, this is a radio frequency linear accelerator (RF-LINAC) which utilizes a laser photo cathode. RF-LINAC technology is known in the art. RF-LINAC's are commercially available from entities, such as, Varian Corporation and Grummen Corporation.

CPA technology is known as described in U.S. Pat. No. 5,235,606.

The next component of the system is a plasma source in which the plasma density profile is tailored. The plasma is generated by a laser photo-ionizing appropriate low molecular weight gas, such as hydrogen or helium, which is contained in a back-filled gas chamber. Alternatively, the gas is emitted from a series of gas jets. The plasma density profile can be tailored, for example, to produce a plasma density channel, by using conventional lasers.

The optical transport system consists of a series of lenses and mirrors, capable of transporting the series of laser pulses from the laser system through the plasma over the entire extent of the accelerator. The plasma itself can help guide and transport the laser pulses by one of two methods, namely, relativistic self focusing in the plasma or plasma density channel focusing.

An electron beam transport system, comprises a series of magnetic fields and magnetic lenses, such as guadrapole or solenoidal magnets, is used to transport the electron beam, in the form of a series of electron bunches, from the electron injector (RF-LINAC) through the plasma over the entire extent of the accelerator.

In the method of the invention, the above described system is used for accelerating the injected electron. The method consists of first resonantly generating a large amplitude plasma wave using an optimized train of laser pulses and second injecting the electron bunches into the proper phase regions of the resulting plasma wave.

More specifically, the large amplitude plasma wave is resonantly generated in the plasma by the optimized series of pulses. The laser pulse train, consisting of a finite number of n pulses, is optimized when it generates the maximum plasma wave amplitude. That is, the maximum electric field of the plasma wave. This optimization is achieved by adjusting or varying one or more of the following parameters of the laser pulse: the pulse length (width), the interpulse spacing, and/or the pulse intensity profile for each of a series of n pulses. This optimization can be accomplished by use of a feedback control system, whereby the plasma wave amplitude is measured, and then the pulse series characteristics are varied, and the plasma wave amplitude is again measured, and so on, until the plasma wave amplitude is maximized.

In one variation of the method, the pulse width ($\tau$) of the series of laser pulses is varied as the axial electric field amplitude ($E_{max}$) of the plasma wave changes. Sometimes pulse width is also referred to interchangeably as pulse length. The results of one-dimensional calculations indicate that it is preferred that $\tau$ (pulse width) is inversely proportional to $E_{max}$ whereby pulse width decreases with increasing electric field amplitude ($E_{max}$). Accordingly, in this embodiment the $\tau$ of the $n^{th}$ pulse is less than the $\tau$ of the (n−1) pulse and the $E_{max}$ imparted to the pulse wave by the $n^{th}$ pulse is greater than the $E_{max}$ imparted to the plasma wave by the (n−1) pulse.

In another variation of the method of the invention, a series of laser pulses is provided and the interpulse spacing is varied with the electric field amplitude ($E_{max}$) of the plasma wave. More specifically, the interpulse spacing is varied proportional to the electric field amplitude of the plasma wave whereby interpulse spacing increases with increasing amplitude of the electric field.

In still another embodiment of the invention, the interpulse spacing is varied in proportion to changes in the wave length of the plasma wave.

In still another embodiment of the invention, the pulse width ($\tau$) is no greater than the length $L_{res}$ of the resonance region of the plasma wave. This resonance region corresponds roughly to the region of the plasma wave where the electrostatic potential is negative and the axial electric field is positive. In the nonlinear regime, $L_{res}$ scales as one over the axial electric field amplitude of the plasma wave.

In still another embodiment of the invention, the pulse has a finite rise time, and pulse width of the $n^{th}$ pulse is no greater than the length of the resonance region of the plasma wave generated by the preceding (n−1) pulse; said region being between $\phi$ (phi) less than zero ($\phi<0$) and the derivative of $\phi$ (phi) with respect to $\zeta$ (zeta) greater than zero ($d\phi/d\zeta>0$), where $\phi$ (phi) is the normalized electrostatic potential of the plasma wake comprising the plasma waves; and $\zeta$ (zeta) is $\zeta=v_g t-z$, where $v_g$ is the group velocity of the laser pulse, t is time, and z is the axial propagation distance.

In a most preferred embodiment, the method for driving a plasma wave comprises imparting energy from a laser pulse to a plasma wave within a resonance region of the plasma wave where the derivatives of $\phi$ (phi) with respect to $\zeta$ (zeta) is greater than zero ($d\phi/d\zeta>0$); where $\phi$ (phi) is the normalized electrostatic potential of the plasma wave; and $\zeta$ (zeta) is $\zeta=v_g t-z$, where $v_g$ is the group velocity of the laser pulse, t is time, and z is the axial propagation distance.

In addition to the pulse widths and interpulse spacing, the intensity profile of the laser pulses can be varied to maximize the axial electric field amplitude of the plasma wave. In one embodiment, pulses with wedge shaped intensity profiles are more efficient in generating the plasma wave than laser pulses with square intensity profiles for a given total laser pulse energy.

In all cases, it is preferred that optimization is achieved by varying one or more of the parameters of pulse width, interpulse spacing, and pulse intensity profile in a manner corresponding to maximizing the axial electric field amplitude of the plasma wave which changes non-linearly.

The exact configuration of the optimized train of laser pulses will depend upon which of the various parameters are varied, and which of the characteristics of the system, namely, the particular RLPA, the laser system parameters, the plasma density, and the plasma geometry, are configured and operated. For example, in the case of a series of half sign laser pulses of equal intensities injected into uniform plasma considered in the one dimensional limit, the optimized length of each subsequent pulse will decrease, whereas, the optimized interpulse spacing for each subsequent pulse will increase. The optimized pulse length (width) of the first pulse corresponds to roughly one half the non-linear plasma wave length in this example. The optimum spacing between the first and second pulses correspond roughly to one non-linear plasma wave length.

In general, if the parameters of a particular RLPA configuration are specified (e.g., the total number of laser pulses, the total laser energy, the plasma density profile, and the laser focal geometry), then the optimal laser pulse train configuration can be determined numerically by using a computer. An optimized laser pulse train corresponds to one which maximizes the axial electric field amplitude of the plasma wave. Experimentally, in the laboratory, this optimization can be done using a feedback control system, as is described below.

Electron bunches are accelerated by injecting them into the proper phase regions of the large amplitude plasma wave. The proper phase region corresponds to the region in which (1) the axial electric field is negative (or positive for positrons) to provide acceleration, and (2) the radial electric field is positive (or negative for positrons) so as to provide radial focusing of the electron beam. The axial extent of this proper phase region corresponds to roughly one fourth of a non-linear plasma wave length.

It is an object of the invention to provide a method for exciting plasma waves by a series of optical pulses each of which is optimized in order to accelerate particles with maximum energy efficiency.

Another object is to provide a method for determining the optimum pulse width, interpulse spacing, and pulse intensity profile for each pulse in a train (series) of pulses in order to drive a plasma wave while maintaining resonance between the pulses and the plasma wave.

Another object is to provide methods for determining optimum laser pulse characteristics to most efficiently drive a plasma wave utilizing empirically observed features in an iterative scheme for independently varying one or more of the characteristics for particle acceleration.

Another object is to provide an apparatus for exciting plasma waves by a series of optical pulses each of which is independently optimized in order to accelerate particles with maximum energy efficiency.

Another object is to provide an apparatus for determining the optimum pulse width, interpulse spacing, and pulse intensity profile for each pulse in a train (series) of pulses and an apparatus for generating such optimized pulses to drive a plasma wave while maintaining resonance between the pulses and the plasma wave.

These and other objects, features, and advantages of the invention will become apparent from the following description of the preferred embodiments, claims, and accompanying drawings.

DETAILED DESCRIPTION OF THE PREFERRED EMBODIMENTS

Figure 1:
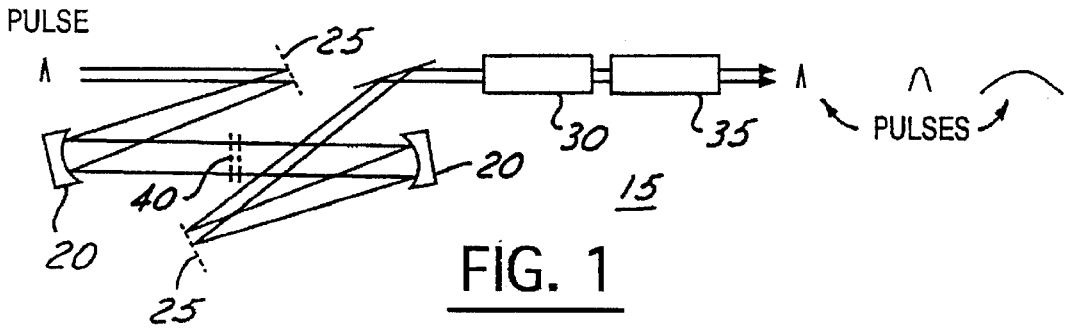
FIG. 1 is a schematic of a variably spaced pulse train with arbitrary pulse widths produced by use of Fourier filtering in the laser stretcher stage.

Before describing the invention, it is useful to understand the problems associated with present acceleration methods. Electron acceleration is limited at high $n_{e0}$ by phase detuning, i.e., accelerated electrons (with $v\rightarrow c$) outrun the plasma wave (with $v_p\approx v_g<c$). The maximum energy gain, $\Delta W_{max}$, of an electron in a 1-D sinusoidal plasma wave of amplitude $E_z=\epsilon E_{WB}$ is $\Delta W_{max}\approx4ec\epsilon E_{WB}\gamma_p^2/W_p$, where $\epsilon\leqq1$ is a constant. Since $\gamma_p\approx\gamma_g\approx w/w_p>>1$, $\Delta W_{max}\approx\gamma m_e c^2(2\gamma_g)^{5/2}$. For example, $\Delta W_{max}\approx4.5$ GeV, assuming a laser wave length of $\lambda\approx2\pi c/w=1$ μm, $n_{e0}=10^{18}$ cm$^{-3}$ ($E_{WB}=7.8$ GV/cm) and $\epsilon=25\%$. Hence, at the high densities required either for self-modulation or for the use of an ultrashort pulse in the standard LWFA, $\gamma_g$ is relatively low and acceleration is limited, $\Delta W\sim\epsilon n_{e0}^{-5/4}$.

More specifically, electron phase detuning is a fundamental limitation in all plasma based accelerators, i.e., accelerated electrons (with $v\rightarrow c$) outrun the plasma wave (with $v_p\approx v_g<c$). Acceleration will cease once the electrons phase advance a distance $(v-v_p)t\approx\lambda_p/2$ relative to the plasma wave, where $\lambda_p=2\pi c/w_p$ is the plasma wave length. In the laboratory frame, this corresponds roughly to $L_t\approx\gamma_p^2\lambda_p$, where v=c has been assumed. It can be shown that the maximum energy gain, $\Delta W_t$, of a trapped electron in a 1-D plasma wave of amplitude $E_z$ is $\Delta W_t\approx4m_ec^2\gamma_p^2E_z/E_0$ for $E_z^2<<1$, and in the nonlinear limit, $\Delta W_t\approx2m_ec^2\gamma_p^2(E_z/E_0)^2$ for $E_0^2>>1$. For example, for a fixed value of $\epsilon=E_z/E_{WB}=0.25$ and a laser wave length of $\lambda=1$ μm, $\Delta W_t\approx4.6$ GeV for $n_{e0}=10^{18}$ cm$^{-3}$ ($E_{WB}=7.7$ GV/cm) whereas $\Delta W_t\approx4.6$ GeV where $\gamma_p\approx w/w_p>>1$ has been assumed. For a fixed $\epsilon$, $\Delta W_t$ $4m_ec^2\gamma_p^3\epsilon^2 n_{e0}^{-3/2}$, assuming $E_z^2/E_0^2>>1$ and $\gamma_p^2>>1$. Hence, at the high densities required either for self-modulation or for the use of an ultrashort pulse in the standard LWFA, $\gamma_g$ is relatively low and acceleration is limited by electron phase detuning.

The invention provides novel methods and apparatus for overcoming problems with plasma wave generation and electron acceleration. The definition of certain terms will facilitate understanding. $\zeta$ is position coordinate along direction of propagation in the frame moving with the laser pulse. $\phi$ is the normalized plasma wave electrostatic potential. $\lambda$ is wave length, usually wave length of light. $\lambda_{NL}$s is nonlinear plasma wave wavelength, changes as the plasma wave amplitude $|\phi|$ increases, $\chi-1=\phi$. The optimized pulse spacing is typically proportional to $\lambda_{NL}$, the nonlinear plasma wave wavelength. $\tau$ is the pulse width $E_z/E_0$ is electric field amplitude normalized to the cold wave breaking field and $E_{max}$ is maximum axial electric field amplitude without normalization. I is laser intensity, usually given in units of Watts/square centimeters (W/cm$^2$).

In the method of the invention, laser pulses are used having laser pulse width in the nanosecond to femtosecond range using a chirped-pulse amplification (CPA) laser system. The basic configuration of such a CPA system is described in U.S. Pat. No. 5,235,606. U.S. Pat. No. 5,235,606 is incorporated herein by reference in its entirety. Chirped-pulse amplification systems have been also described in a publication entitled *Laser Focus World* published by Pennwell in June of 1992. It is described that CPA systems can be roughly divided into four categories. The first includes the high energy low repetition systems such as ND glass lasers with outputs of several joules but they may fire less than 1 shot per minute. A second category are lasers that have an output of approximately 1 joule and repetition rates from 1 to 20 hertz. The third group consists of millijoule level lasers that operate at rates ranging from 1 to 10 kilohertz. A fourth group of lasers operates at 250 to 350 kilohertz and produces a 1 to 2 microjoules per pulse. In 5,235,606 several solid state amplifying materials are identified and the invention of 5,235,606 is illustrated using the Alexandrite. Ti:Sapphire is also commonly used in the basic process of 5,235,606, with some variations as described below.

The illustrative examples described below generally pertain to pulse energies in the 0.1 joule (J) to 100 joule range with pulse width in the range of 50 fs (femtoseconds) to 50 ps (picoseconds) and the wave length on the order of 1 micron (μm). But these examples are merely illustrative and the invention is not limited thereby.

In a basic scheme for CPA laser (15), first a short pulse is generated. Ideally the pulse from the oscillator (not shown) is sufficiently short so that further pulse compression is not necessary. After the pulse is produced it is stretched in a stretcher comprising mirrors (20) and gratings (25) arranged to provide positive group velocity dispersion. (FIG. 1.) The amount the pulse is stretched depends on the amount of amplification. A first stage of amplification typically takes place in either a regenerative or a multipass amplifier (30). In one configuration this consists of an optical resonator that contains the gain media, a Pockels cell, and a thin film polarizer. After the regenerative amplification stage the pulse can either be recompressed or further amplified. The compressor (35) consists of a grating or grating pair arranged to provide negative group velocity dispersion. Gratings are used in the compressor are designed, constructed, and arranged to correspond to those in the stretching stage. More particulars of a typical system are described in U.S. Pat. No. 5,235,606, previously incorporated herein by reference. The system (15) also includes mask (40) described below.

Figure 2:
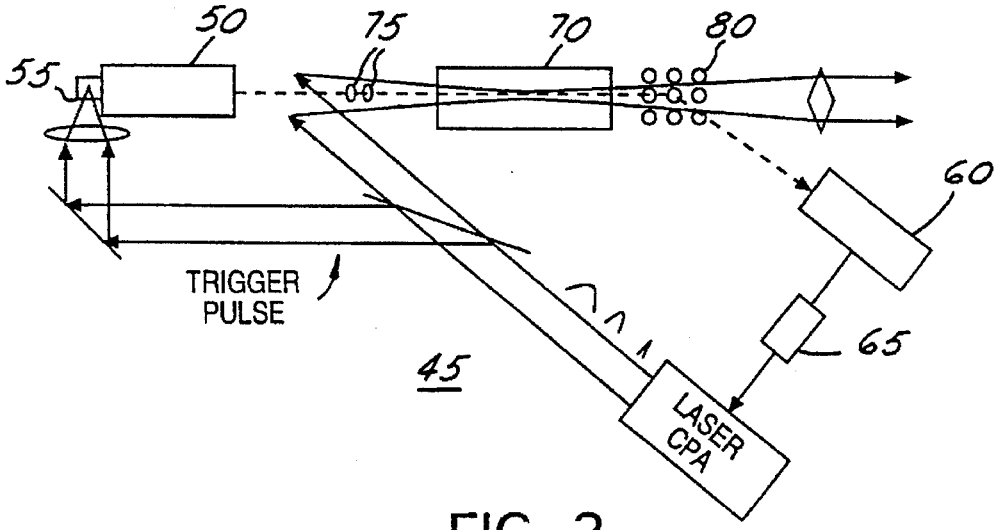
FIG. 2 is a schematic of the accelerator system.

As shown in FIG. 2, the accelerator system (45) comprises several parts: the laser system (15) (FIG. 1) (with its pulse-shaping subsystem); the electron gun system (50), also called beam source, which preferably comprises photo cathode electron source and RF-LINAC accelerator; electron photo-cathode triggering system (55); the electron diagnostics (60); and the feedback system (65) between the electron diagnostics (60) and the laser system (pulse-shaping subsystem). The system (45) also includes plasma source including vacuum chamber (70), magnetic lens (75), and magnetic field means (80). The laser system produces a train of pulses that has been optimized to maximize the axial electric field amplitude of the plasma wave, and thus the electron acceleration, using the method of the invention. This is, of course, only a first iteration; the actual optimization is done experimentally. Once the electron acceleration is measured with the electron diagnostics, the feedback system between the electron diagnostics and the laser system (pulse shaping subsystem) will determine the next setting for the optimized train. The method of the invention to be further discussed below, adjusts the pulse widths and spacings—for fixed pulse amplitudes—alternatively, such that the electron acceleration is maximized. The amplitudes could also be varied but that is considered less efficient.

The electron gun system consists of an accelerator to pre-accelerate the electrons up to an energy corresponding to the injection energy required for them to be trapped by the wave. The trapping threshold depends on the phase velocity and amplitude of the wakefield; for the relativistic plasma waves below wave breaking considered in the paper, this trapping threshold is approximately greater than or equal to (≧) 1 MeV. An RF-LINAC could serve this purpose, being compact and relatively inexpensive, but several other low energy accelerators would also work. The electron bunch is synchronized to the laser pulse train, and thus the plasma wave phase, using a laser triggered photo cathode in the electron gun, triggered by the trigger pulse, derived from a beamsplitter, as shown in FIG. 2. The vacuum chamber (70) houses the gas jet or cell where the plasma and plasma wave are generated. The electron spectrometer consists of a magnetic field which bends the electron trajectories in proportion to their energies. The energy of the electrons is measured with scintilators coupled to photomultiplier tubes, or with solid state electron detectors.

An important aspect of the invention is the production of a characteristic pulse train or series of pulses required for wakefield generation. One method, as shown in FIG. 1, is to use Fourier filtering. In this case, a mask (40) is placed in the pulse stretcher of a CPA system to modify the phase and/or amplitude of every component of the initial pulse in such a way that, when it is recompressed, a series of pulses with arbitrary spacings and widths will be produced. The minimum rise time of each individual pulse is still governed by the gain bandwidth of the amplifiers.

This technique has been demonstrated quite effectively in the case of an unamplified pulses using a zero dispersion stretcher, i.e., the gratings of the stretcher or separate zero dispersion stretcher system being located at the focal plane of the lenses. The possible difficulties that are encountered with amplification of the pulses are: (1) reduction of the bandwidth due to gain narrowing, (2) distortion of the pulse shapes due to gain saturation, and (3) nonlinear interference between pulses, which overlap in time in the amplifiers when they are stretched. The first problem, gain narrowing, also limits the minimum pulse width of a single pulse, and is overcome by use of larger bandwidth gain media or a combination of amplifiers with different gain media, having adjacent but different central frequencies, effectively producing a larger net bandwidth. The second problem, gain saturation, can be avoided by reducing the single stage amplification and adding more amplifier stages if necessary. The last problem is circumvented by avoiding any fast amplitude modulation of the chirped pulse in order to minimize nonlinear effects in the amplifier; this implies that phase masks are preferable to amplitude masks. Shaped pulses have already been amplified in the laboratory, at least in preliminary ways, but more development is necessary.

By use of either a computer controlled liquid crystal display mask (40), or an acoustoptic modulator mask (40), located in the Fourier plane, the pulses may be modulated in real time (between shots). This provides the possibility of maximizing the wakefield experimentally using real time feedback between the modulator and a diagnostic of the plasma wave amplitude. A possible problem with the use of spatial filtering with finite resolution is spatial diffraction of the laser beam, the effect of which is to create a spatially dependent temporal pulse profile. However, this is less of a problem for wakefield generation than for other applications of pulse shaping, because the wakefield is excited at the laser focus, in the far field, and because it is sensitive to the laser pulse envelope and not changes in the carrier frequency.

Figure 3:
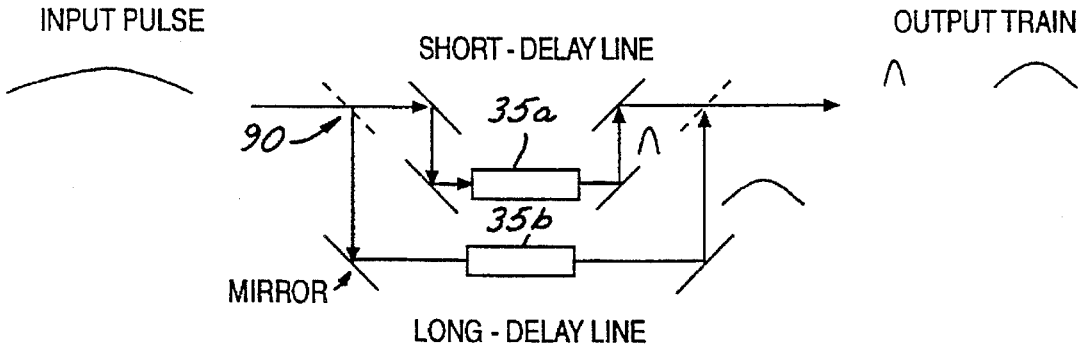
FIG. 3 is a schematic of a system in which beamsplitters produce several amplified stretched pulses by means of several separate compressors and respective delay lines.

A less elegant method (FIG. 3) of producing optimized pulse trains is to divide the amplified stretched pulse by use of beamsplitters (90) placed after the amplifiers (30), then send the separate pulses to separate compressors (**35*a*, 35*b*), with adjustable lengths and delays, and finally recombine the pulses before they enter the interaction chamber (70). Alternatively, several pulses could be created using a beam-splitter and separate delay lines (as in a Michelson interferometer) placed before the amplifiers, but, as mentioned above, this may create high frequency beating of the chirped pulses, inducing deleterious effects. (FIG. 3**.)

It is preferred that the plasma have a desired density profile which is substantially constant in the axial direction (z) over an extended length corresponding to one or more Rayleigh lengths. The Rayleigh length is defined as that length over which the beam spot size has not increased by more than $\sqrt{2}$ over its minimum spot size for a laser beam propagating in a vacuum.

In the transverse (radial) dimension, it is desirable that the plasma density increase approximately parabolically, such that the plasma profile forms a density channel about the axis. This plasma density channel can act as a plasma optical fiber, preventing laser pulse diffraction, and allowing the laser pulses to propagate over many Raleigh lengths without spreading.

The advantage, however, of the pulse shaping technique discussed in the previous paragraphs is that the pulse widths and interpulse spacings may be tailored independently of each other, unlike the case of optical mixing, as is used in the standard beatwave accelerator.

The systems as shown in FIGS. 1 through 3 are used to provide optimized laser—plasma interaction according to an experimental method of the invention which will now be described. Such method depends on the optimization of pulses according to properties of the plasma as derived below.

$$\frac{d^2}{d\zeta^2}\phi = k_p^2\gamma_g^2\left[\beta_g\left(1-\frac{(1+a^2)}{\gamma_g^2(1+\phi)^2}\right)^{-1/2}-1\right] \quad (1)$$

$$\chi^2 = 2\gamma_g^2\{(\chi_0-\chi)+\beta_g[(\chi^2-\gamma\perp^2/\gamma_g^2)^{1/2}]\} \quad (2)$$

$$\chi_{min_n} = \gamma_g^2[\chi_{max_n}(1+\beta_g^2)-2\beta_g(\chi_{min_n}^2/\gamma_g^2)^{1/2}] \quad (3)$$

$$\chi_{max_n} = \gamma_g^2[\chi_{min_{n-1}}(1+\beta_g^2)-2\beta_g(\chi_{min_{n-1}}-\gamma\perp_n^2/\gamma_g^2)^{1/2}] \quad (4)$$

$$\hat{E}^2_{max_n} = 2\gamma_g^2[\chi_{max_n}-1/\gamma_g^2-\beta_g(\chi_{max_n}-1/\gamma_g^2)^{1/2}] \quad (5)$$

$$2\chi'' = \gamma\perp^2/\chi^2-1 \quad (6)$$

$$\chi_{max_n} = \gamma\perp_1^2\gamma\perp_2^2\ldots\gamma\perp_n^2 \quad (7)$$

$$\hat{E}_{max_n} = \chi_{max_n}^{1/2}-\chi_{max_n}^{1/2} \quad (8)$$

$$L_n = (2/k_p)\chi_{max_n}^{1/2}E_x(\rho_n) \quad (9)$$

$$\lambda_{Nn} = (4/k_p)\chi_{max_n}^{1/2}E_2(\hat{\rho}_n) \quad (10)$$

$$\eta_R \simeq 1-(w_p^2/2w^2)(1+\phi) \quad (11)$$

$$L_{res} = (2/k_p)\chi_{max_n}|E_2(\pi/2,\hat{\rho}_n)-E_s(\alpha_1,\hat{\rho}_n)| \quad (12)$$

The laser pulse is described by the normalized transverse vector potential, $\vec{a}=e\vec{A}_\perp/m_ec^2$. The laser envelope, |a|, is assumed to be nonevolving and a function of only $\zeta=v_gt-z$, where $v_g$ is the group velocity (assumed constant), i.e., the "quasi-static" approximation. Circular polarization is assumed, i.e., $a^2=a^2(\zeta)$. The quantity $a^2$ is related to the laser wave length $\lambda$ and intensity I by $a\approx 6\times10^{-10}\lambda[\mu m]I^{1/2}[W/cm^2]$.. The plasma response is described by the normalized electrostatic potential, $\phi=e\Phi/m_ec^2$, which in the 1-D limit obeys the nonlinear Poisson equation. See equation (1), where $\beta_g=v_g/c$, $\gamma_g=(1-B_g^2)^{-1/2}$ and $K_p=w_p/c$ is the plasma wave number. In deriving equation (1) $\phi$ was assumed to be a function of only $\zeta$, i.e., $v_p\approx v_g$. In the limit $a^2<<1$, $\gamma_g=w/w_p/c$ (nonlinear corrections are discussed). As previously mentioned, the laser pulse structure is assumed to be non-evolving. This ignores various effects, such as diffraction, pump depletion and laser—plasma instabilities. A one dimensional laser-plasma interaction model is assumed. Generalization to higher dimensions requires a more complex interaction model.

Several properties of the plasma wave can be determined analytically from equation (1) for a series of square laser pulses. When $a^2$ is constant, equation (1) can be integrated to yield equation (2), where $\chi=1+\phi$, $\gamma\perp=(1+a^2)^{1/2}$ and $\chi_0$ is an initial condition, i.e., $\chi=\chi_0$ at $\chi'=0$. Here, $\chi'=k_p^{-1}d\phi/d\zeta$ and is the normalized axial electric field of the plasma wave, i.e., $\chi'=\hat{E}_z\equiv E_z/E_0$, where $E_0=m_ec^2k_p/e$ (sometimes referred to as the cold, nonrelativistic wave breaking field).

Consider an optimized square pulse train where $a_n$ is the amplitude of the $n^{th}$ pulse. For the first pulse, equation (2) is solved with $a=a_1$ and the initial condition $\chi_0=\chi_{min_0}=1$. Equation (2) is the integrated from the front of the pulse to the back. The optimal pulse length, $L_1$, is determined by the $\zeta$ distance required to reach maximum potential within the pulse, i.e., $\chi'=0 \wedge \chi=\chi_{max_1}$. The wake behind the first pulse is given by solving equation (2) with $a^2=0$ using the initial conditions $\chi'=0 \wedge \chi_0=\chi_{max_1}$. The potential of the wake oscillates between $\chi_{max_1}$ and $\chi_{min_1}$. The distance required to reach the minimum potential, $\chi'=0$ and $\chi=\chi_{min_1}$, is defined to be one half the nonlinear plasma wave length, $\lambda_{N1}/2$. The optimal spacing between the first and second pulse is determined by placing the front of the second pulse at the position in the wake of the first pulse for which $\chi'=0$ and $\chi=\chi_{min_1}$. Hence, the optimal spacing between the first and second pulse is some odd multiple of $\lambda_{N1}/2$. In general, for an optimized square pulse train, it can be shown that the amplitude of the wake behind the $n^{th}$ pulse oscillates between $\chi_{min_n}\leqq\chi\leqq\chi_{max_n}$, according to equations (3) and (4). And where in equation (4), $\chi^\perp\gamma^\perp_n=(1+a_n^2)^{1/2}$ and $\chi_{min_0}\equiv1$. Furthermore, the maximum electric amplitude behind the $n^{th}$ pulse is given by equation (5), where $e^\wedge_{max_n}=E_{max_n}/E_0$. In deriving equations (3) through (5), the spacing between pulses and the pulse lengths are assumed to be optimized, such that the $n^{th}$ pulse begins at $\chi=\chi_{min_{n-1}}$ and ends at $\chi=\chi_{max_n}$. Both the optimal width $L_n$ of the $n^{th}$ pulse and the nonlinear wave length of the wake behind the $n^{th}$ pulse (and, hence, the optimal spacing between pulses) increase with increasing n. Wave breaking occurs when the electron fluid velocity becomes equal to the plasma wave phase velocity $v_g$. When this occurs, the electron fluid density becomes singular. From equation (1), wave breaking occurs when $\chi_{min_n}\rightarrow1/\gamma_g$, which implies $\chi_{max_n}\rightarrow\chi_{WB}=(2\gamma_g^2-1)/\gamma_g$. This corresponds to a wave breaking electric field of $\hat{E}_{WB}^2=2(\gamma_g-1)$, or $E_z=E_{WB}$.

The above results, i.e., equations (3) through (5), are valid for laser pulses with arbitrary group velocities $v_g\leqq c$, become important at high plasma densities, since $v_g<c$, become important at high plasma densities, since $\gamma_g\approx w/w_p\sim1/n_{e0}^{1/2}$. In the limit $v_g=c$, equations (1) through (5) simplify significantly. Numerical solutions to equation (1) indicate that for $\chi^2<<\chi_{WB}^2$ and $\gamma_g^2<<1$, equation (1) can be approximated by the limit $\beta_g\rightarrow1$, i.e., according to equation (6), where the prime denotes $k_p^{-1}d/d\zeta$. For a series of optimized square pulses, analytic solutions can also be readily obtained from this reduced equation. In particular, as per equations (7) and (8), $\chi_{max_n}$ and $\hat{E}_{max_n}$ are further defined $\chi_{min_n}=1/\chi_{max_n}$. Furthermore, the optimal width of the $n^{th}$ pulse, $L_n$, and the nonlinear wave length of the wake behind the $n^{th}$ pulse, $\lambda_{Nn}$, are given by equations (9) and (10), where $E_2$ is the complete elliptic integral of the second kind, $p_n^2=1-\gamma\perp_n\chi_{max_n}^{-2}$ and $\hat{P}^2=1\ \chi_{max_n}^{-2}$. The optimal spacing between the end of the $n^{th}+1$ pulse is an odd integer multiple of $\lambda_{Nn}/2$. Note for equal pulse amplitudes, i.e., $a_1=a_2=\ldots$ $\equiv a_0$, $\chi_{max_n}=\gamma_{\perp 0}^{2n}=(1+a_0^2)^n$. In the limit $\chi_{max_n}^2>>1$, $k_pL_n\approx 2\gamma_{\perp 0}^n$, $k_p\gamma_{Nn}\approx 4\gamma_{\perp 0}^n$, $\Lambda\ \chi'_{max_n}\approx k_p\gamma_{\perp 0}^n$.

Figure 4:
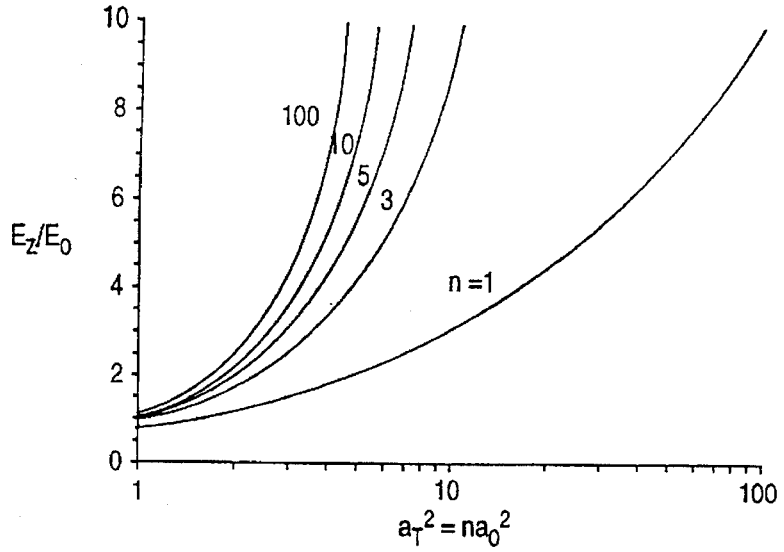
FIG. 4 is a graph of the maximum electric field ($\hat{E}_{max_n}$) versus the quantity $a_\tau^2=na_0^2$ for n=1, 3, 5, 10, and 100.

The maximum normalized electric field, $\hat{E}_{max}=\chi_{max}=E_{max}/E_0$, for an optimized train of n square pulses of equal amplitudes is plotted in FIG. 4 versus the quantity $a_T^2\approx na_0^2$, using the above derivation and method.

Figure 5:
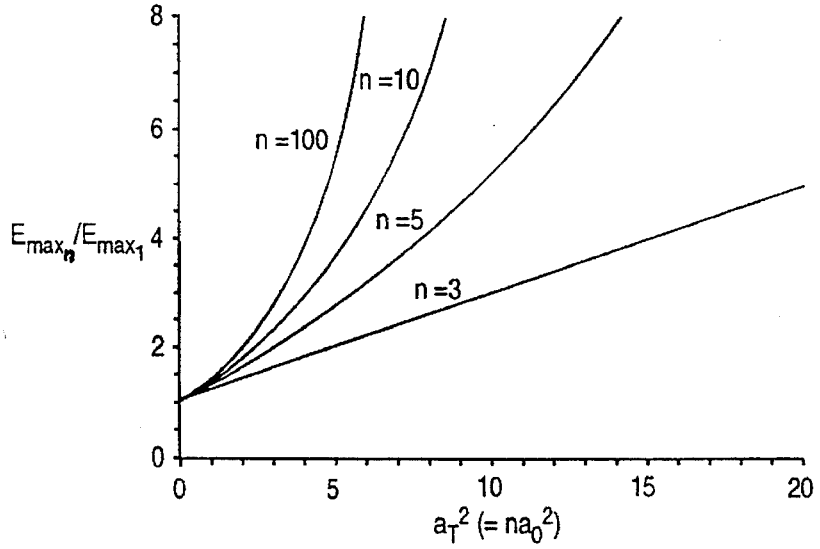
FIG. 5 is a graph of the maximum field achieved with a train of pulses ($\hat{E}_{max_n}$) over that achieved with a single pulse ($\hat{E}_{max_1}$) of the same energy versus the quantity $a_\tau^2=na_0^2$ for n=3, 5, 10, and 100.

For $\gamma_g>>1$ and $\chi^2<<\chi_{WB}^2$, $\hat{E}$ is approximately of $n_{e0}$. The curves show the result for 1, 3, 5, 10, and 100 pulses. FIG. 4 indicates that just a few optimized square pulses are far more efficient than a single pulse. For example, at $n_{e0}=10^{15}$ $cm^{-3}$ ($\lambda$=1 μm, $\gamma_g\approx 10^3$, $E_{WB}$ 1.3 GV/m), three square pulses can be used with an intensity $I=3.5\times 10^{18}$ W/cm²/pulse ($a_0^2$=1.3) and a total pulse train fluence of $I\tau_{tot}$=27 MJ/cm² to produce $E_z$=0.1 GV/cm. Here $\tau_{tot}$ is the sum of the pulse durations in the train and $2.7\ a_0^2\approx 10^{-18}\lambda^2[\mu m]I[W/cm^2]$. A single pulse at $n_{e0}=10^{15}$ $cm^{-3}$ requires $I=3.2\times 10^{19}$ W/cm² ($a_0^2$=12) over an order of magnitude higher intensity than in each pulse in the train, and a total fluence six times greater ($I\tau_{tot}$=130 MJ/cm²), to produce this same $E_z$. (A low density was chosen for this example so that finite rise time effects could be neglected.) FIG. 4 indicates that the amplitude efficiency advantage of multiple pulses increases with increasing number of pulses n or total laser intensity $a_0^2$. FIG. 5 shows the ratio of the maximum field achieved with a train of pulses ($\hat{E}_{max_n}$) over that achieved with an equivalent energy single pulse ($\hat{E}_{max_1}$) versus $a_n^2$, demonstrating the energy efficiency of the RLPA as compared with the LWFA.

A. Square Pulses

Figure 6:
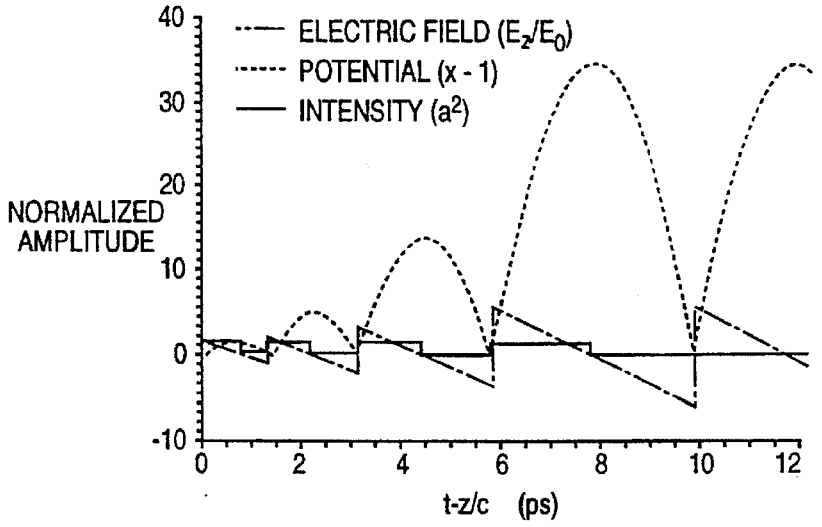
FIG. 6 is a graph of numerical solutions for an optimized square pulse train at $n_e=10^{16}$ cm$^{-3}$ and with $a_0=1.2$.

FIG. 6 shows an example of an optimized pulse train (n=4, $a_0$=1.2, $n_{e0}=10^{16}$ $cm^{-3}$), as obtained by a numerical solution of equation (1), in which the widths and spacing between pulses are varied in order to maximize $\chi_{max}$.

For numerical reasons, square pulses that have small but finite rise times are selected, which is valid, in the limit of low density as was used in the example of FIG. 6. It is found that $E_z$=0.56 GV/cm for $I\tau_{tot}$=19 MJ/cm².

The laser pulses are optimally located in the regions where $d\phi/d\zeta>0$. If the laser pulse is located in the region of $d\phi/d\zeta<0$, it will absorb energy from, and reduce the amplitude of, the plasma wave. Likewise, if it is in the region of $d\phi/d\zeta>0$, it will impart energy to, and increase the amplitude of, the plasma wave. Whether or not the laser pulse absorbs energy from or imparts energy to the plasma wave depends on the sign of $d\eta_R/d\zeta$, where $\eta_R$ is the index of refraction. In the limit $v_g$=c, the 1-D nonlinear index of refraction for an intense laser pulse in a plasma is given by equation (11).

When $d\eta_R/d\zeta<0$ (i.e., $d\phi/d\zeta<0$), the pulse photons will frequency up-shift as they propagate, hence the pulse absorbs energy from the wave. Frequency down-shifting (giving energy to the plasma wave) requires $d\eta_R/d\zeta>0$ (i.e., $d\phi/d\zeta>0$). Hence, to enhance the plasma wave amplitude, pulses are optimally placed where $d\phi/d\zeta>0$.

When a train that is not optimized is used, for instance fixed interpulse spacings (as in the case of the PBWA), $\chi_{max}$ reaches some saturated value before being driven down by destructive interference when the pulses become out of phase with the wave, i.e., when they are located in regions where $d\phi/d\zeta<0$. This is referred to as resonance detuning. Within the optimal (absorption) region, the plasma wave is driven most effectively near $\phi=\phi_{min}$ (where both the fluid velocity and density of electrons are maximum), and least effectively as $\phi\rightarrow\phi_{max}$.

B. Sine Pulses

The above results are varied in the limits of either infinitesimally short rise times, or low density. In practice, the rise time $\tau_{rise}$ of a pulse directly out of a laser is finite and determined by the bandwidth of the laser amplifiers; e.g., currently, the minimum amplified pulse width is $\tau_{min}\approx$50 fs. In order to study the effects of plasma density and finite rise times on efficiency, consider pulses with an envelope provide $a(\zeta)$ given by a half-period of a sine function. (That Gaussian profiles give qualitatively similar results is verified in other simulations.)

Figure 7A:
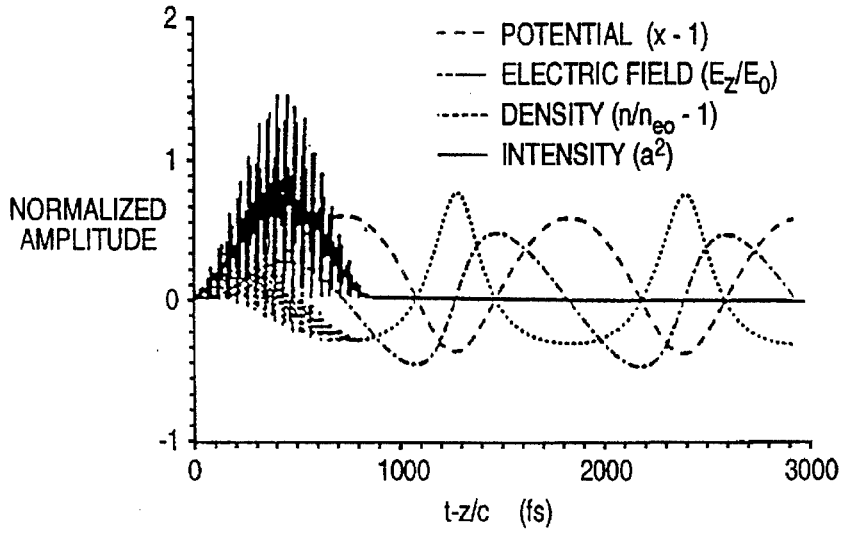
FIG. 7 consists of 7 (A) and 7 (B) which are graphs of numerical solutions for LWFA and RLPA with sine shaped pulses: (A) Single sine pulse at $n_e=10^{16}$ cm$^{-3}$ with $a_0\approx1.2$, and (B) an optimized sine pulse train at $n_e=10^{16}$ cm$^{-3}$ with $a_0=1.2$.
Figure 7B:
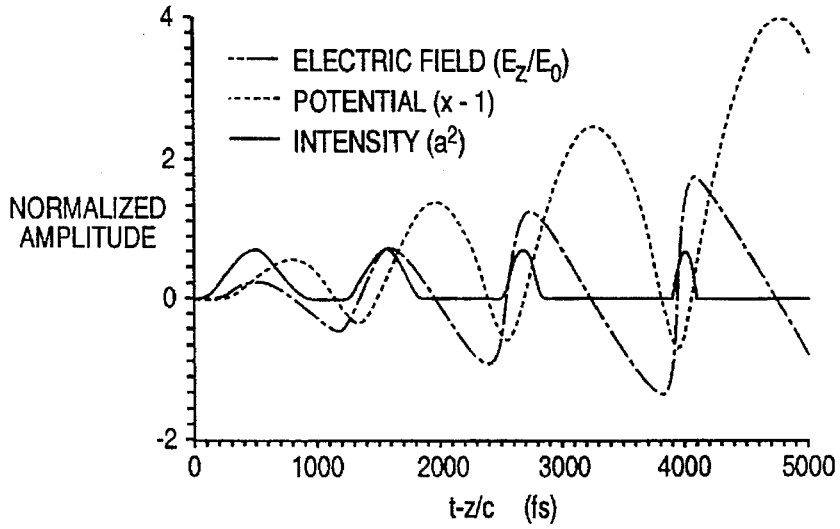

FIG. 7 (A) is a plot of the wakefield resulting from single pulse excitation (LWFA) including fast oscillations of the laser pulse. For this example, $n_{e0}=10^{16}$ $cm^{-3}$, $a_0$=1.2, and the pulse is linearly polarized, i.e., $1.4_0^2\approx 10^{-18}\lambda^2[\mu m]I[W/cm^2]$.

The high frequency density fluctuation inside the laser pulse envelope is due to fast component of the ponderomotive force at twice the laser frequency, i.e., $a^2=(\hat{a}^2/2)(1+\cos 2k\zeta)$ for $a=\hat{a}\cos k\zeta$. FIG. 7 shows an example of a sine pulse train that was optimized numerically. For the laser amplitude, only the envelope, averaged over the fast oscillations, is shown. For this pulse train, n=4, $a_0$=1.2, $n_{e0}=10^{16}$ $cm^{-3}$, and the pulses are linearly polarized. The first pulse in FIG. 7 (B) has an optimum pulse width $\tau=\tau_{opt}$=940 fs (resonant with $n_{e0}=10^{16}$ $cm^{-3}$ and $a_0$=1.2) and the final pulse has $\tau=\tau_{opt}=\tau_{min}\approx$200 fs ($I\tau_{tot}$=2.2 MJ/cm²), which gives $E_z$=0.18 GV/cm ($\epsilon$=0.07). As in the square wave case, $\lambda_{Nn}$, and thus the spacing between pulses, increases with each succeeding pulse as $\chi_{max}$ increases.

1. Plasma Wave Phase Resonance Region

Note that whereas with increasing $\chi_{max}$, $\tau_{opt}$ for succeeding square wave pulses increases $\tau_{opt}\sim\lambda_{Nn}/c$, the opposite is true for multiple sine pulses. This difference arises because, whereas for square pulses $\tau$ is independent of $\tau_{rise}$, for sine pulses $\tau\approx 2\tau_{rise}$. It is more advantageous to have a short sine pulse width ($\tau<<\lambda_{Nn}/c$), so that the highest pulse amplitude is reached near $\phi_{min}$ (where it is most effective in driving the plasma wave), than to have a long sine pulse width ($\tau\approx\lambda_{Nn}/c$), so that the pulse is driving the wave for a longer time, albeit mostly when it is less effective (away from $\phi_{min}$). Sine pulses are found to be more effective than square pulses for this same reason. For the later sine pulses, $\tau_{opt}$ is found to be approximately given by the width of the region between where $\phi<0$ and $d\phi/d\zeta>0$, which defines a "phase resonance width" $L_{res}$ for finite rise time pulses see FIG. 7.

Figure 8:
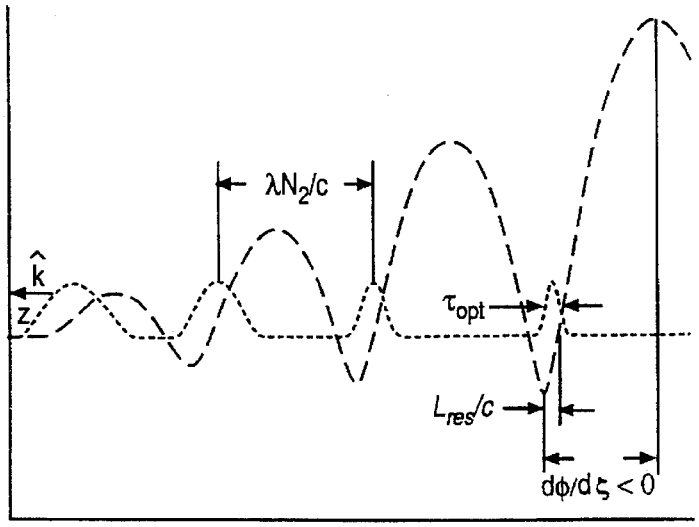
FIG. 8 is a graphical representation showing legends explaining the definitions of various optimization parameters.
Figure 9:
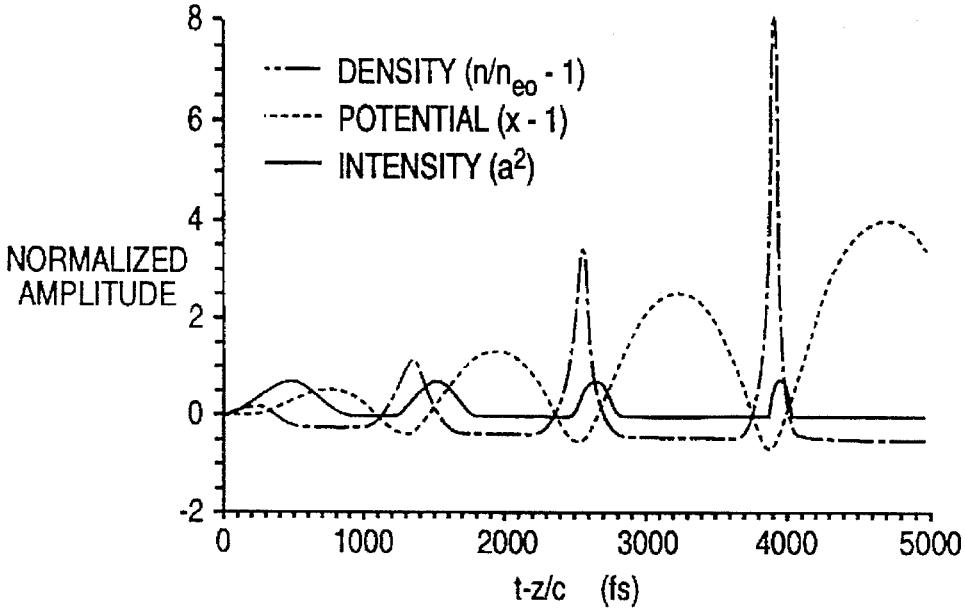
FIG. 9 is a graph of numerical solutions for the RLPA with sine shaped pulses at $n_e=10^{16}$ cm$^{-3}$ and $a_0=1.2$, showing plasma wave density instead of electric field.

The physical origin of $L_{res}$ is that in this region (1) the ponderomotive force of the laser pulse is in the right phase with the electron motion to give energy to the plasma wave, and (ii) the density of electrons with which the laser pulse can interact is highest. The latter is clearly seen in FIG. 8, which is the same as FIG. 6, except the plasma wave density is plotted instead of the electric field.

For the wake behind the $n^{th}$ pulse, $L_{res}$ can be determined from equation (1) in the limit of $v_g$=c, according to equation (12) where $\hat{P}_n^2\sin^2\alpha_1=1-\chi_{max_n}^{-1}$. In the limit $\chi_{max_n}>>1$, $L_{res}\rightarrow k_p^{-1}\ \chi_{max_n}^{-1/2}\approx 1/\hat{E}_{max_n}$ and, hence, the resonance becomes sharper with increasing plasma wave amplitude ($Q\equiv\lambda_{Nn}/L_{res}\sim\chi_{max_n}$).

Figure 10:
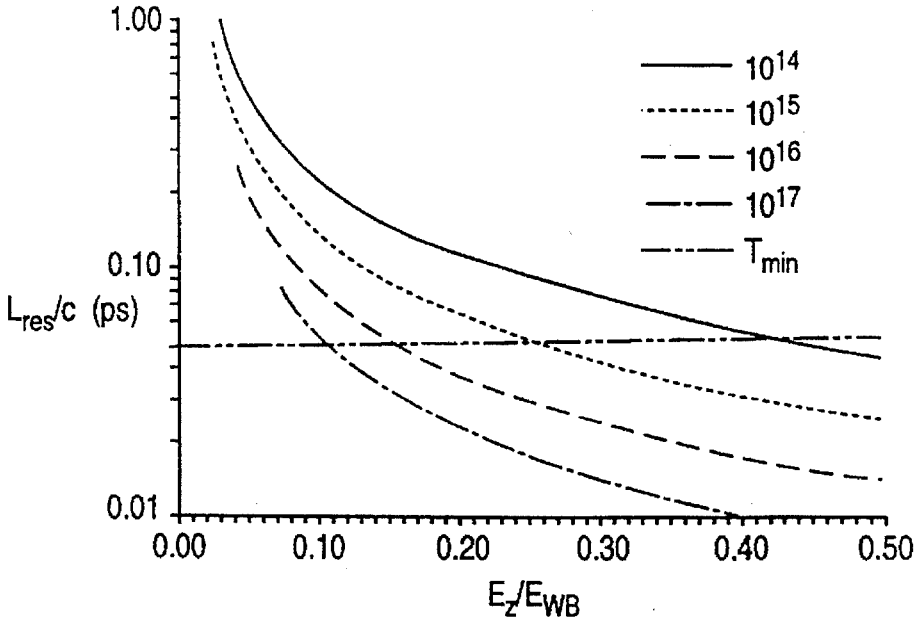
FIG. 10 is a graph of $L_{res}/c$ versus $\epsilon$ for various densities. Finite rise time effects are important for $L_{res}/c<\tau_{min}$.

FIG. 10 shows a plot of $L_{res}/c$, which approximates $\tau_{opt}$, versus $\epsilon$, where $\epsilon=E_z/E_{WB}$, for various densities.

In the regime of high $n_{e0}$, finite rise time effects become important at high $\epsilon$, i.e., $\tau_{opt}$ decreases below $\tau_{min}$ as $\epsilon$ increases beyond a critical value (e.g., $L_{res}/c<$50 fs for $\epsilon$=0.16 at $n_{e0}=10^{16}$ $cm^{-3}$). Since pulses with $\tau<\tau_{min}\approx$50 fs cannot currently be produced, the later pulses in a train will not be optimized. Although the later pulses with $\tau=\tau_{min}>\tau_{opt}$ will continue to increase $\epsilon$, they will do this less effectively than a train in which all pulses are of optimal widths. In fact, a pulse train in this high $n_{e0}$ regime can be less amplitude efficient than a single optimized pulse at the same density;

i.e., a greater $I\tau_{tot}$ is required for the pulse train to achieve a given $E_z$ at fixed $n_{e0}$. But, the reduction in efficiency for pulses with longer than optimal $\tau_n$ is more than compensated by a reduction in the sensitivity of the wakefield amplitude to changes in $\lambda_N$. Furthermore, high $n_{e0}$ is unfavorable for electron acceleration because of electron phase detuning, $\Delta W_f \sim \epsilon^2 n_{e0}^{-3/2}$ in the $\hat{E}_z^2 >> 1$ and $\gamma_g^2 >> 1$ regime.

2. Efficiency Comparison Between RLPA and LWFA

FIG. 10 indicates that, for low $n_{e0}$ and up to the previously mentioned value of $\epsilon$, i.e., $\epsilon_{opt} \approx L_{res}/c \geqq \tau_{min} \geqq 50$ fs can be satisfied for all of the pulses in the train [as was the case of FIG. 7 (B)]. Consequently, multiple sine pulses in this regime are found to be similar to ideal square pulses in that a pulse train is more amplitude efficient than a single pulse at the same density. Specifically, 8 times higher intensity ($a_0$=3.4, $\Lambda$ I=1.6×10$^{19}$ W/cm$^2$), corresponding to 2.5 times more fluence ($I\tau_{tot}$=5.6 MJ/cm$^2$), is required of a single pulse ($\tau=\tau_{opt}$=700 fs for $n_{e0}=10^{16}$ cm$^{-3}$) to reach the same value of $E_z$ (0.18 GV/cm) as is reached by the train of FIG. 4 (B). Reducing the intensity required to reach large plasma wave amplitudes also reduces strongly driven instabilities, such as stimulated Raman scattering, self-focusing, or filamentation, which disrupt either the plasma wave or the laser beam. Pulse-to-pulse phase incoherence of the high frequency laser oscillations can also reduce instabilities. A single pulse with the same intensity and pulse width as the first pulse in FIG. 7 (B), corresponding to 0.43 times the laser fluence ($I\tau_{tot}$= 2.4 MJ/cm$^2$, results in a 3.9 times smaller $Ee_z$ (46 MV/cm).

In order to drive the same $E_z$ with the same I as a sine pulse train, a higher $n_{e0}$ must be used with a single sine pulse. (Recall that, for a single pulse, $E_z \sim n_{e0}^{1/2} I$ for $a_0^2<1$.) Thus, the same value of $E_z$=0.18 GV/cm as is reached by the train in FIG. 7 (B) is obtained by a less intense single pulse ($a_0$=0.7) with $\tau=\tau_{opt}$=90 fs at $n_{e0}=10^{18}$ cm$^{-3}$, and with 70 times less energy ($I\tau_{tot}$=30 kJ/cm$^2$). The maximum energy gain, as determined by electron phase detuning is ($\Delta W_f$=400 keV for the single pulse. Since energy gain favors low $n_{e0}$, the pulse train in FIG. 7 (B) can accelerate an electron to an energy that is orders of magnitude greater; i.e., $\Delta W_f$=400 GeV, 1000 times greater than the single pulse. Thus, a pulse train of equivalent intensity—at either equal or lower $n_{e0}$—can accelerate an electron to greater energy than a single pulse. Table I gives a summary of the various laser, plasma, and acceleration parameters that were found in the above comparison between the sine pulse train and the single sine pulse. Table II gives the same parameters found in the comparison between the square pulse train and the single square pulse.

TABLE I

| | Train (4 Pulses) | 1 Pulse | 1 Pulse |
|---|---|---|---|
| Plasma density $n_e$ (cm$^{-3}$) | $10^{16}$ | $10^{16}$ | $10^{18}$ |
| Wave breaking field $E_{WB}$ (GV/cm) | 2.4 | 2.4 | 7.7 |
| Longitudinal field $E_Z$ (GV/cm | 0.18 | 0.18 | 0.18 |
| Plasma wave length $\lambda_p$ (μm) | 330 | 330 | 33 |
| Laser field $E_L$ (GV/cm) | 38 | 110 | 22 |
| Laser wave length $\lambda$ (μm) | 1.0 | 1.0 | 1.0 |
| Laser pulse width $\tau_N$ (fs) | 940-660-400-200 | 700 | 90 |
| Laser intensity $a_0^2$ | 1.4/pulse | 12 | 0.5 |

TABLE I-continued

| | Train (4 Pulses) | 1 Pulse | 1 Pulse |
|---|---|---|---|
| Laser intensity I (W/cm$^2$) | 2 × 10$^{18}$/pulse | 1.6 × 10$^{19}$ | 7 × 10$^{17}$ |
| Laser power [P ≧ Iπ($\lambda_p$/2)$^2$] (PW) | 1.7 | 14 | 6 × 10$^{-3}$ |
| Total laser fluence [$I\tau_{tot}$] (MJ/cm$^2$) | 2.2 | 5.6 | 0.031 |
| Dephasing length $L_t$ (cm) | 2.2 × 10$^3$ | 2.2 × 10$^3$ | 2.2 |
| Pump depletion length $L_d$ (cm) | 3.0 × 10$^3$ | 7.8 × 10$^3$ | 40 |
| Total energy gain ΔW (TeV) | 0.4 | 0.4 | 4.2 × 10$^{-4}$ |

Table I: A summary of the various laser, plasma, and acceleration parameters that were found in the comparison between the sine pulse train (first column) and the single sine pulse with the same plasma density (second column) and the single sine pulse with higher density (third column).

TABLE II

| | Train (3 Square Pulses) | Single Pulse |
|---|---|---|
| Plasma density $n_e$ (cm$^{-3}$) | $10^{15}$ | $10^{15}$ |
| Wave breaking field $E_{WB}$ (GV/cm) | 1.3 | 1.3 |
| Longitudinal field $E_Z$ (GV/cm) | 0.1 | 0.1 |
| Plasma wave length $\lambda_p$ | 1000 | 1000 |
| Laser wave length $\lambda$ (μm) | 1.0 | 1.0 |
| Laser pulse width $\tau_n$ (ps) | 2-2.5-3.1 | 4.1 |
| Laser intensity $a_0^2$ | 1.3 pulse | 12 |
| Laser intensity I (W/cm$^2$) | 3.5 × 10$^{15}$/pulse | 3.2 × 10$^{19}$ |
| Laser power [P ≧ Iπ($\lambda_p$/2)$^2$] (PW) | 27 | 250 |
| Total laser fluence [$I\tau_{tot}$] (MJ/cm$^2$) | 27 | 130 |
| Dephasing length $L_t$ (cm) | 1.1 × 10$^5$ | 1.1 × 10$^5$ |
| Pump depletion length $L_d$ (cm) | 3.0 × 10$^4$ | 1.5 × 10$^5$ |
| Total energy gain ΔW (TeV) | 3 | 11 |

TABLE II: A summary of the various laser, plasma, and acceleration parameters that were found in the comparison between the square pulses train and the single square pulse with the same plasma density.

3. Efficiency Comparison Between RLPA and PBWA

Figure 11A:
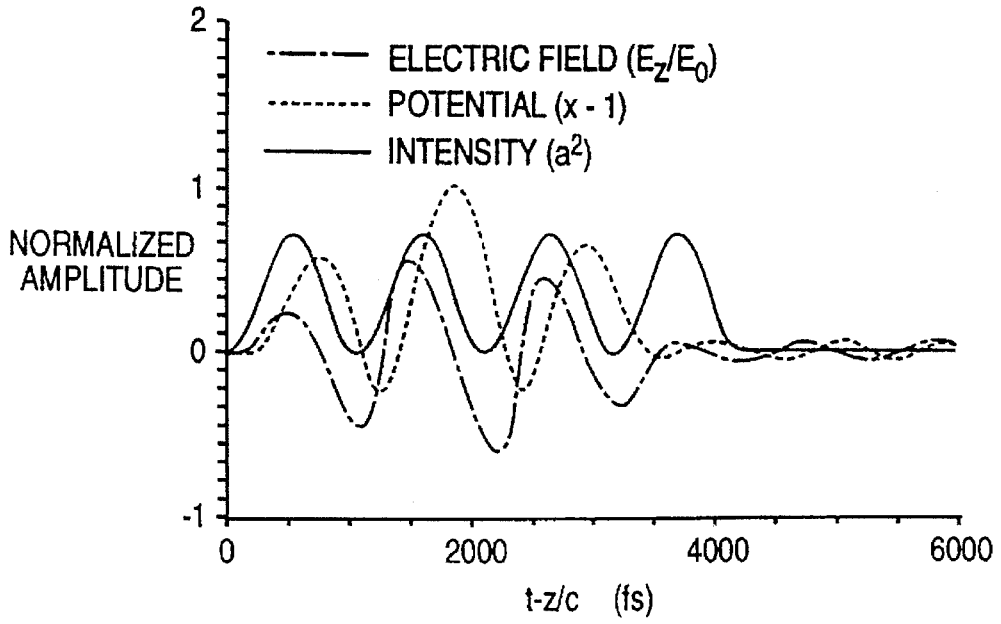
FIG. 11 consists of 11 (A) and 11 (B) which are graphs showing numerical solutions for the PBWA: (A) without optimization, showing the effects of detuning, and (B) with optimization.
Figure 11B:
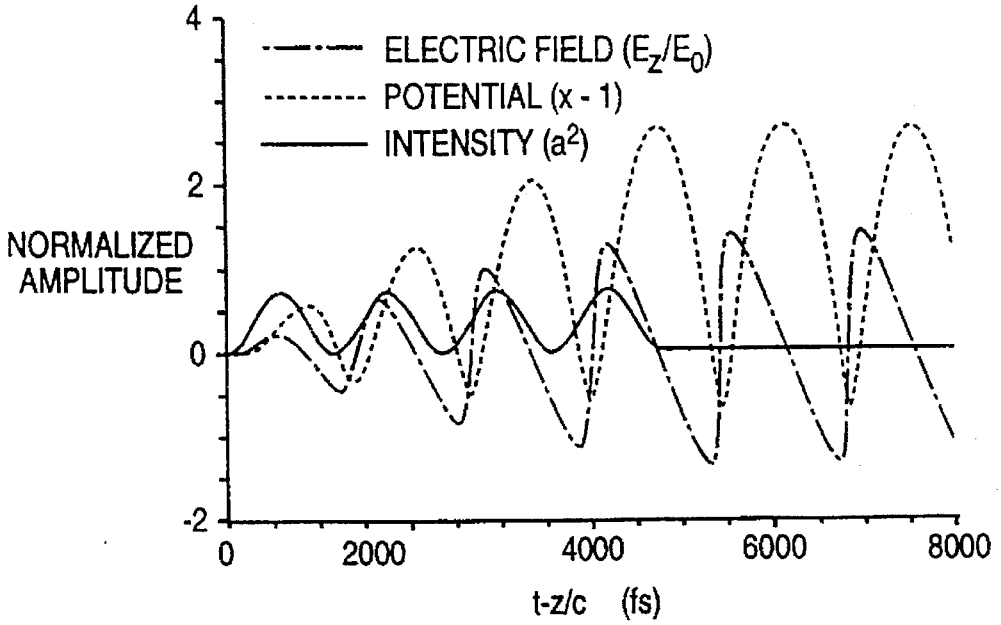

Thus far, the RLPA concept has been compared only to the LWFA; in this section, it is compared to the PBWA. In the example of FIG. 11 (A), four beat pulses were assumed with amplitudes $a_0$=1.2 in a plasma of density $n_{e0}=10^{16}$ cm$^{-3}$.

FIG. 11 shows numerical solutions for the PBWA: (a) without optimization, showing the effects of detuning, and (b) with optimization.

In this case, the unperturbed plasma wave frequency was used for the beat frequency in a PBWA pulse train, $\Delta w \sim w_p$. However, as expected in this nonlinear regime, resonance detuning between the plasma wave and the PBWA laser train is observed. Therefore, for a more reasonable comparison, the pulse width for the PBWA needs to be optimized for a given plasma density, as was done for the RLPA, but in this case with the constraint that the pulse widths, pulse amplitudes, and interpulse spacings are kept constant for all pulses in the train. The PBWA optimized in this manner is shown in FIG. 11 (B). A beatwave wave length greater than the one corresponding to the unperturbed density $\lambda_p$ is found to be optimum, compensating for the increase in the non-linear wave length $\lambda_N$ that arises from the increase in plasma wave amplitude. As can be seen from FIG. 11 (B), the net effect is to move the spacing between the peaks of the laser pulses closer to $\lambda_N$, and thus the locations of the peaks closer to the plasma wave resonance regions ($L_{res}$). Although the final wake of the optimized PBWA is found in the example of FIG. 11 (B) to be similar to that in the RLPA scheme for comparable laser pulse intensities, it should be emphasized that much more energy was required for the former. This is related to the fact that the RLPA is more efficient than the PBWA not only because it mitigates resonance detuning by adjusting to the change in $\lambda_{Nn}$ as the plasma wave grows, but because it also adjusts to the change in the phase resonance width, i.e., the plasma wave is driven more efficiently when $\tau_{opt}\approx L_{res}$ as in the RLPA than when $\tau_{opt}\approx L_n/c\sim\lambda_{Nn}/2c$ as in the PBWA.

It is useful to compare the wakefields produced by the various concepts given equal total laser fluence (or energy), since that is the technological limitation imposed by the type of lasers capable of the high intensities required. The intensity and pulse width were varied in such a way that the total laser energy and number of pulses (n=4) were kept the same for both the PBWA and the RLPA. It is found that the optimized PBWA is less energy efficient than either the RLPA or the LWFA for a given density. For example, a PBWA pulse train with $a_0$=1.0, $\tau$=1.2 ps, where $\tau$ is the pulse width for each pulse, and total fluence in the pulse train equal to $I\tau_{tot}$=3.4 MJ/cm$^2$, produced a normalized wakefield amplitude of $E_z/E_0$=0.4 at a density of $n_{e0}=10^{16}$ cm$^{-3}$ ($E_0$=96 MV/cm). An equivalent energy RLPA train ($a_0$=1.6, $\tau_{tot}$=1.9 ps) gave $E_z/E_0$=3.0, which is 7.5 times larger. In another example with $n_{e0}=10^{16}$ cm$^{-3}$, a LWFA single pulse with $I\tau_{tot}$=5.2 MJ/cm$^2$ ($a_0$3.4, $\tau$=700 fs) produced a wake larger by a factor of 1.2, $E_z/E_0$=1.7, than an equivalent energy PBWA (four pulses) with $a_0$=1.2 and $\tau$=1300 fs, which generated $E_z/E_0$=1.4. These results are summarized in Tables III and IV. Thus based on the previous discussion, the RLPA is the most energy efficient of all three schemes in this parameter regime.

TABLE III

| | RLPA | PBWA |
|---|---|---|
| Plasma density $n_e$ (cm$^{-3}$) | $10^{16}$ | $10^{16}$ |
| Total laser fluence $I\tau_{tot}$ (MJ/cm$^2$) | 3.4 | 3.4 |
| Laser intensity $a_0^2$ | 2.6/pulse | 1.0/pulse |
| Laser pulse width $\tau_n$ (fs) | 940-540-320-100 | 1200 |
| Longitudinal field $E_Z/E_0$ | 3.0 | 0.4 |

Table III: A comparison between the RLPA and PBWA at the same plasma density and laser energy fluence shows that the former produces a 7.5 times greater wakefield.

TABLE IV

| | LWFA | PBWA |
|---|---|---|
| Plasma density $n_e$ (cm$^{-3}$) | $10^{16}$ | $10^{16}$ |
| Total laser fluence $I\tau_{tot}$ (MJ/cm$^2$) | 5.2 | 5.2 |
| Laser intensity $a_0^2$ | 11 | 1.4/pulse |
| Laser pulse width $\tau_n$ (fs) | 700 | 1300/pulse |
| Longitudinal field $E_Z/E_0$ | 1.7 | 1.4 |

Table IV: A comparison between the LWFA and PBWA at the same plasma density and laser energy fluence shows that the former produces a 1.2 time greater wakefield.

4. Wakefield Amplitude vs. Interpulse Spacing and Pulse Width

The sensitivity of the growth of $\hat{E}_{max}$ to changes in the pulse widths $\tau$ and interpulse spacings $\lambda_{Nn}$ of the laser pulses of FIG. 7 (B) ($n_e=10^{\neq}$cm$^{-3}$ and $a_0\approx1.2$) was studied numerically.

Figure 12A:
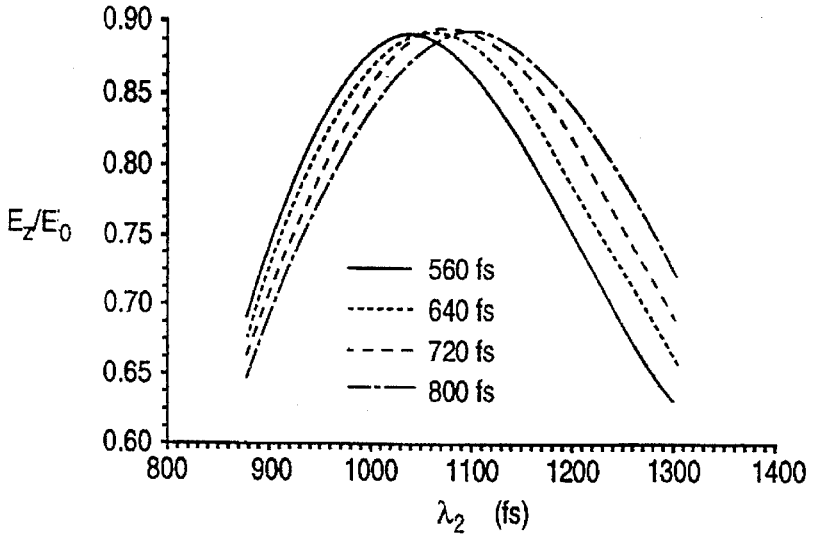
FIG. 12 consists of 12 (A), 12 (B), and 12 (C) which are groups showing the maximum electric field $\hat{E}_{max_n}$ produced by varying both the pulse widths $\tau$ and interpulse spacings $\lambda_{Nn}$, for the second n=2 (A), third n=3 (B), and fourth n=4 (C) pulses. Note the change in scaling of $\hat{E}_{max}$ for the three plots.
Figure 12B:
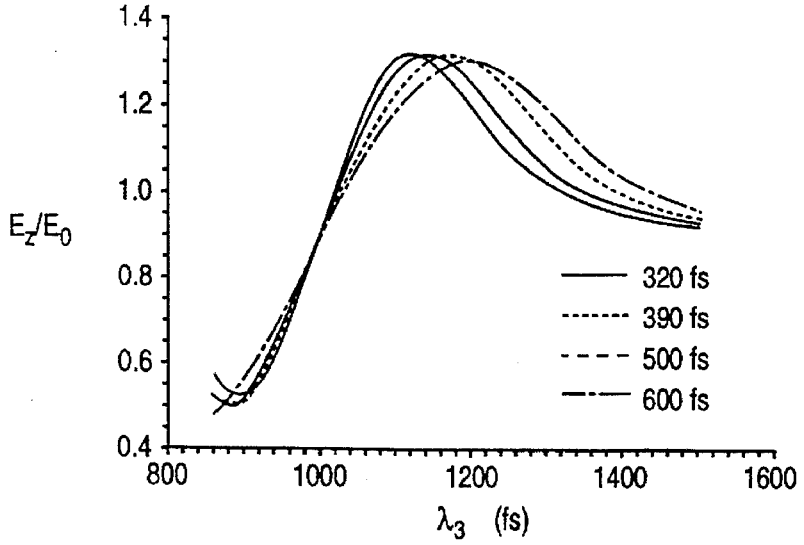
Figure 12C:
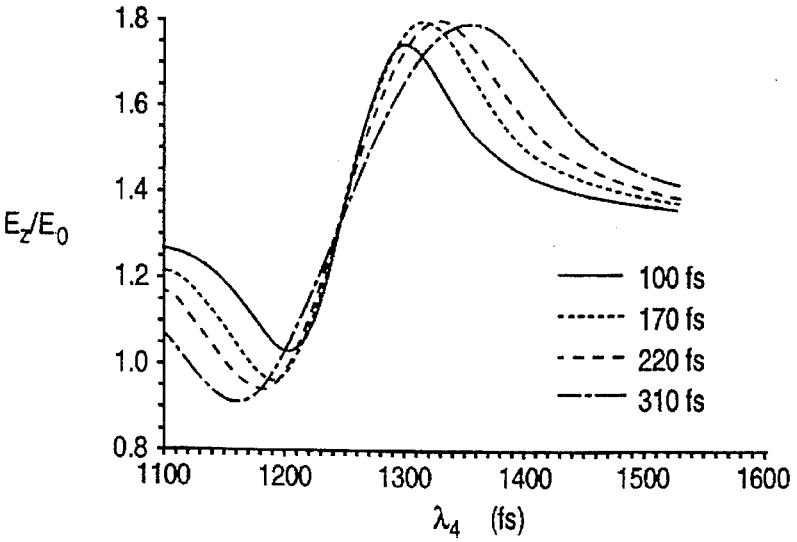

FIG. 12 shows the maximum electric field $\hat{E}_{max_n}$ produced by varying both the pulse widths $\tau$ and interpulse spacings $\lambda_{Nn}$, for the second n=2 (a), third n=3 (b), and fourth n=4 (c) pulses. Note the change in scaling of $\hat{E}_{max}$ for the three plots.

It is governed by both the number of pulses and the Q f the resonance, where $Q\sim\chi_{max}$ is as defined earlier. This can be seen from FIG. 12 plot of the maximum electric field $\hat{}_{max}$ produced by varying both $\tau$ and $\lambda_{Nn}$, for the second n=2 (a), third n=3 (b), and fourth n=4 (c) pulses of the train shown in FIG. 7 (B). For instance, from FIG. 12 (C), it appears that the fourth pulse n=4 is highly sensitive to absolute changes in $\tau$ or $\lambda_{Nn}$ in the vicinity $\tau=\tau_{opt}$.

It can clearly be seen from FIG. 12 (C) that the wake from pulses with $\tau>\tau_{opt}$, without sacrificing much efficiency. For instance, if the pulse width of the last pulse (n=4) were $\tau$=300 fs$\approx1.5\tau_{opt}$ (instead of $\tau_{opt}$), it is found that a decrease in the optimal spacing between the last and the third pulse ($\lambda_{Nn}$) by 25 fs (corresponding to $\delta\lambda_{N_3}/c\tau_{opt}$=13%) results in a decrease of $E_z$ (from the value obtained using $\tau=\tau_{opt}$ and the optimal position) by only 2.2% (instead of 5%). Note in the $\tau=1.5\tau_{opt}$ case, $I\tau_{opt}$=2.3 MJ/cm$^2$, corresponding to a laser pulse train energy increase of only 4.5%.

The added pulses can also absorb the plasma wave, i.e, the maximum electric field ($\hat{E}_{max_n}$) can be reduced to a value below that without it ($\hat{E}_{max_{n-1}}$), when th spacing ($\lambda_n$) is reduced such that the pulse becomes located in the $d\phi/d\zeta<0$ region. Absorption can be optimized just as amplification can, by varying $\tau$ and $\lambda_N$, with the maximum about of absorption equaling the maximum amount of amplification. The second pulse can in fact totally absorb the plasma wave produced by the first pulse, the energy oft he plasma wave going into upshifting the frequency of the light.

The wakefield amplitude is less sensitive to an increase in the spacing ($\lambda_n$), since this moves the pulse further from the $d\phi/d\zeta<0$ region, and thus the wake continues to be enhanced, but less effectively. As $\lambda_n$ increases beyond its optimum value, $\hat{E}_{max_n}$ approaches asymptotically the value it had without the pulse, $\hat{E}_{max_{n-1}}$. Thus, the larger the value of n, the less the sensitivity to spacing, since the value of $\hat{E}_{max_{n-1}}$ is large to begin with, and thus the relative change, $\Delta\hat{E}_{max_n}/\hat{E}_{max_{n-1}}$ cannot be as large as it is for, say, the n=2 pulse, for which $\hat{E}_{max_{n-1}}=\hat{E}_{max_1}$ is smaller. (See the scaling change of $\hat{E}_{max_n}$ for the three plots of FIG. 12.

5. Wakefield Amplitude vs. Plasma Density

Figure 13A:
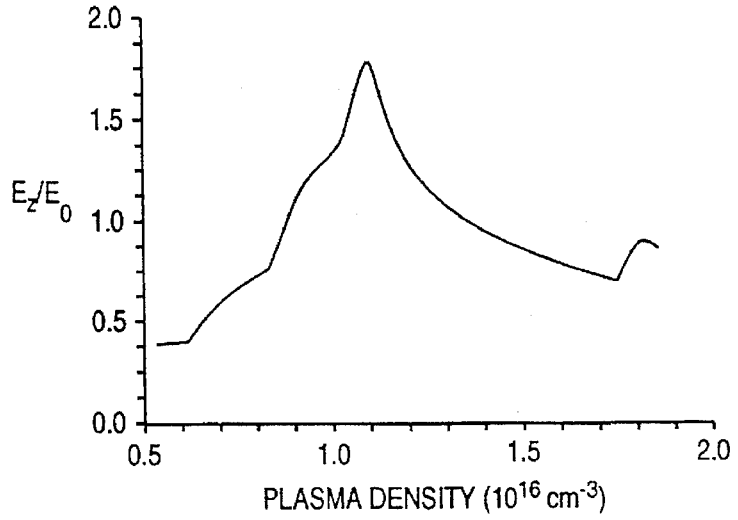
FIG. 13 consists of 13 (A), 13 (B), and 13 (C) which are graphs showing final wakefield amplitude as a function of the initial plasma density for: (A) RLPA, (B) PBWA, and (C) LWFA. The arrows indicate the densities corresponding to the resonant densities in the linear approximation, $\Delta w=w_p(n_e)$ for fixed $\Delta w$ in the PBWA, and $\tau=2\lambda/w_p(n_e)$ for fixed $\tau$ in the LWFA.
Figure 13B:
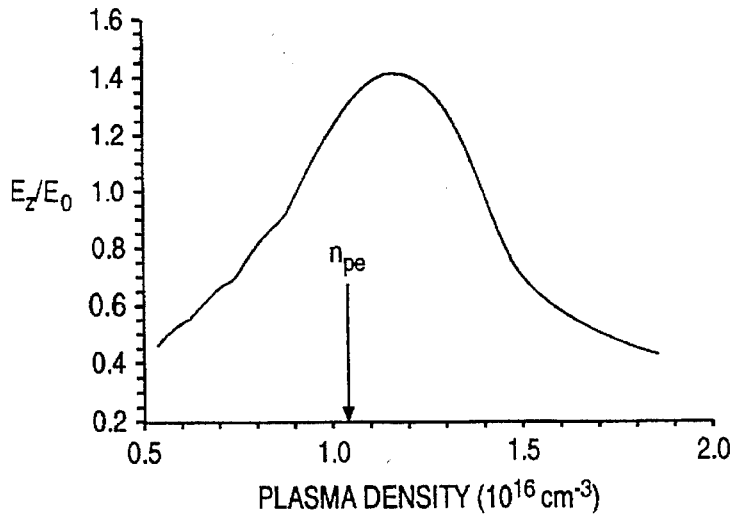
Figure 13C:
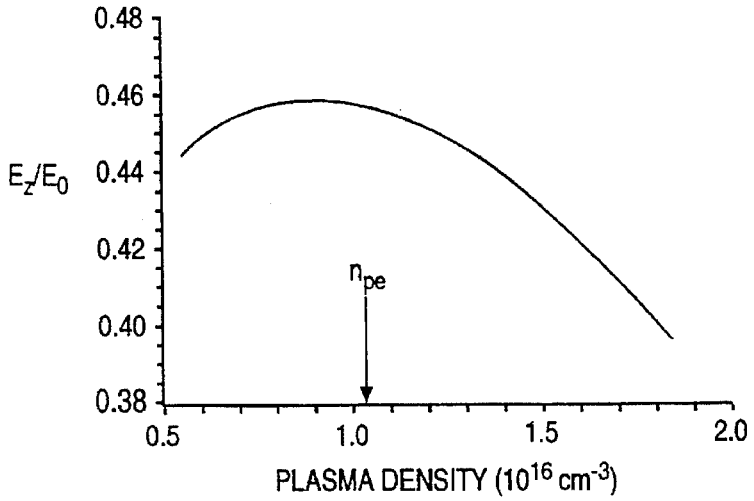

Since the exact resonant plasma density is difficult to produce with current technology, we will consider the stability of the final RLPA wakefield to variation of the ambient plasma density. In FIG. 13 (A), the sensitivity of the wakefield versus the ambient plasma density for the pulse train in FIG. 7 (B) is shown.

The density resonance width is 0.51, which is defined as $\Delta n_e/n_{e0=(nu}-n_L(/n_{e0}$, where $n_u$ and $n_L$ are the upper and lower values of the ambient density for which the wake amplitude is half of its peak value (the peak value occurs at the resonant ambient density ne0). For comparison, the density resonances for the PBWA pulse train of FIG. 11 (B) and the LWFA pulse of FIG. 7 (A) are shown in FIG. 13 (B) and FIG. 13 (C), respectively. The arrows indicate the densities corresponding to the resonant densities in the linear approximation, $\Delta w = w_p(n_e)$ for fixed $\Delta w$ in the PBWA, and $\tau = 2\pi/w_p(n_e)$ for fixed $\tau$ in the LWFA. As expected, since it is impulsively driven, the LWFA is found to be the least density sensitive, with a resonance width equal to 3.90. For the PBWA, the corresponding density resonance width is found to be equal to 0.62. Thus despite the much greater efficiency of the RLPA than the PBWA, their sensitivities to ambient density variation are similar. Achieving a density uniformity meeting this requirement should pose no significant technology challenges—at least for a proof-of-principle experiment—since, in fact, by use of multiphoton ionization, uniform laboratory plasmas have been created over distances on the order of 10 cm.

6. Wakefield Amplitude vs. Laser Intensity

Figure 14A:
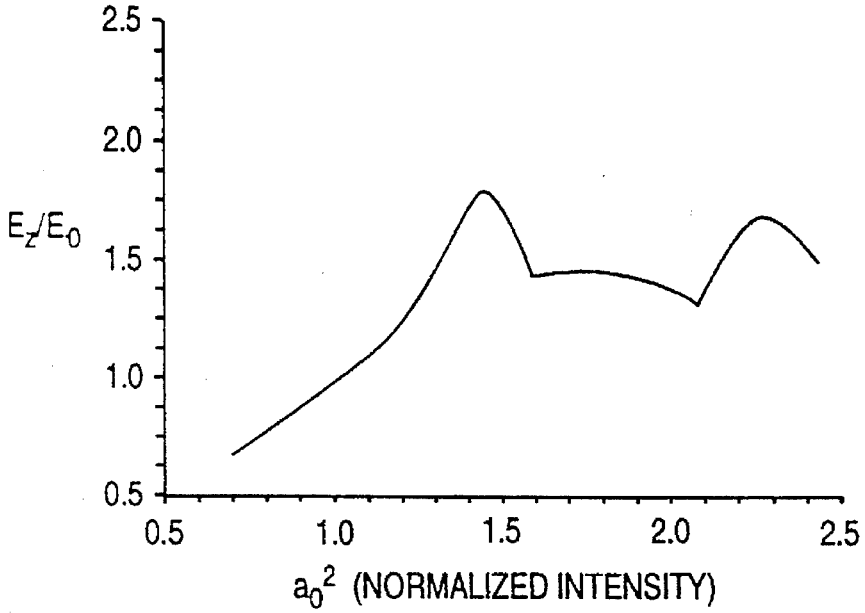
FIG. 14 consists of 14 (A) and 14 (B) which are graphs showing final wakefield amplitude as a function only of the laser intensity (constant $\lambda_n$ and $L_n$) for (A) RLPA, and (B) PBWA.
Figure 14B:
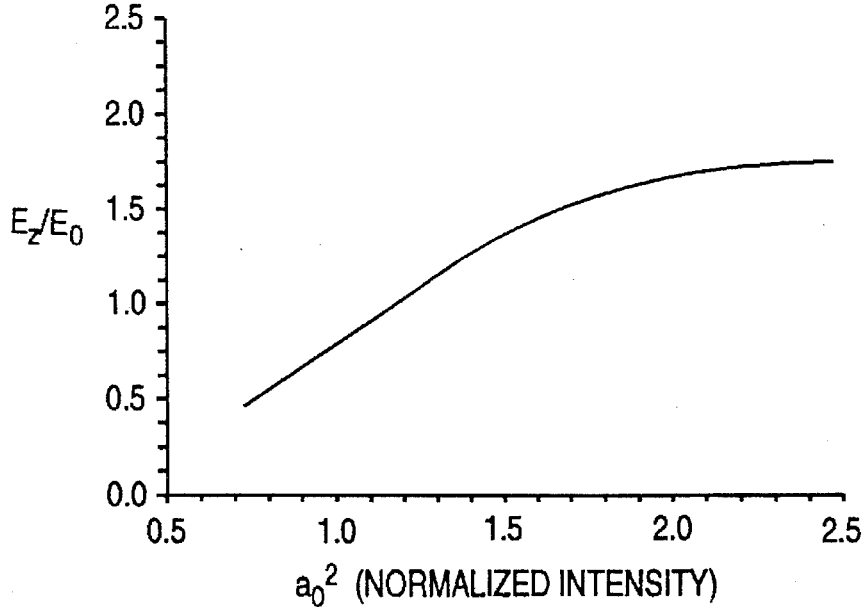

In addition to density variation, shot-to-shot laser intensity fluctuations can result in detuning. FIG. 14 (A) shows the dependence of wakefield amplitude on the laser intensity for the RLPA, with the same pulse widths and interpulse spacings as were used in the pulse train shown in FIG. 7 (B).

As usual it is assumed here that the intensities of all pulses in the train are the same. Note the multiple peaks and sudden discontinuities in the slope of the curve. They correspond to the various pulses coming in and out of resonance as $\hat{E}_{max}$ and thus $\lambda_N$ change with increasing intensity. The peak at $a_0^2=1.4$ corresponds to optimization of all pulses. As the intensity ($a_0^2$) increases, the position of the fourth pulse moves toward the absorption region ($d\phi/d\zeta<0$) and thus $\chi_{max}$ becomes reduced. At $a_0^2=1.6$, the fourth pulse moves into the emission region again ($d\phi/d\zeta>0$) and there is a sharp discontinuity. Another discontinuity appears at $a_0^2=2.1$ as the third pulse moves from the absorption to the emission region The peak at $a_0^2\sim2.3$ corresponds to the fourth pulse reaching resonance again. Unlike the RLPA case (FIG. 14 (A)), FIG. 14 (B)—which shows the sensitivity of the PBWA—does not have several peaks, since the pulses in this care are much longer than $L_{res}$, and since the intensity in this example was optimized in such a way that detuning would not occur. However, as can be seen from FIG. 14 (A), the amplitude fluctuations of the RLPA are in the worst case only 20% for a 10% change in laser intensity, which does not represent a serious problem since shot-to-shot intensity stabilities of $\leqq$5% are achievable.

In summary, the plasma wave axial electric field amplitude is maximized by optimizing the parameters (characteristics) of the laser pulse train, that is, the laser pulse width, the interpulse spacing, and the pulse intensity profile. In the one dimensional limit, this optimization was done analytically for a square pulse train and numerically for a train of sine pulses with realistic rise times. By optimally varying the pulse widths and interpulse spacings, resonance detuning between the laser pulses and the plasma wave can be eliminated. This means that plasma waves can be driven up to the limits imposed by wave breaking, particle trapping, and/or the limits of laser pulse train technology.

Resonant regions of the plasma wave phase space were found where the plasma wave was driven by the laser pulses most efficiently (i.e., the regions were $\phi<0$ and $d\phi/d\zeta$ 0). In order to overlap the laser pulses with these regions, the optimal interpulse spacings were found to increase as the plasma wave amplitude (and nonlinear plasma wave length $\lambda_N$) increases. On the other hand, the width of this phase resonance region $L_{res}$—and thus the optimal finite rise time laser pulse width $\tau_{opt}$—decreases with increasing plasma wave amplitude, due to wave steepening. It also decreases with increasing background density, in this case due to the relationship $\tau\sim2\pi/w_p\sim n_e^{-1/2}$, familiar from single pulse excitation (LWFA).

The sensitivities of the wakefield to changes in the plasma density and laser intensity were not found to pose significant technological problems. Wakefields from trains with somewhat longer than optimal pulse widths were found to be considerably less sensitive to variation of interpulse spacing without sacrificing much efficiency.

The RLPA was found to have advantages over either the PBWA or the LWFA, since comparable plasma wave amplitudes may be generated at lower plasma densities, reducing electron phase detuning, or at lower laser intensities, reducing laser—plasma instabilities. The increased efficiency of the RLPA arises not only because it mitigates resonance detuning by adjusting to the change in $\lambda_{Nn}$ as the plasma wave grows, but also because it adjusts to the change in the phase resonance width, i.e., the plasma wave is driven more efficiently when $\tau_{opt}\approx L_{res}/c$ than when $\tau_{opt}\approx L_n/c\sim\lambda_{Nn}/2c$ as in the PBWA. This advantage exists even at relatively low plasma wave amplitudes, far from wave breaking when the change of $\lambda_{Nn}$ is not significant, but the change of $L_{res}$ is significant.

If large single stage energy gains are desired (>100 GeV), then low plasma densities $n_e\leqq10^{16}$ cm$^{-3}$) are advantageous because of the favorable scaling of the pump depletion distance, the phase detuning distance, and the phase resonance width. However, in order to reach the required high intensities, and yet remain in the 1-D regime, large laser powers (PW) will be necessary, because of the increase in the plasma wave length with decreasing density. Such larger laser systems will be available within the next few years. In the nearer term, for lower energy gain applications (GeV), or proof of principle experiments, higher plasma densities ($n_e\leqq10^{18}$ cm$^{-3}$) can be used. In this case, much lower laser powers are sufficient (TW), which are currently available from table top lasers with ultrashort pulses ($\tau\leqq100$ fs).

The development of CPA technology during the past several years has revolutionized terawatt lasers and their applications. With the advent of CPA, $T^3$ lasers are now capable of producing multi-terawatt, subpicosecond laser pulses in a compact (table top), inexpensive (hundreds of thousands of dollars) system. Such laser systems are ideal to drive the RLPA of the invention. In addition, CPA lasers are inherently well suited for pulse shaping/pulse train generation techniques. In a CPA system, a subpicosecond pulse is stretched to several nanoseconds in duration, amplified to high energy, and then recompressed, thus producing an ultrahigh power, subpicosecond pulse. It has been demonstrated that by placing a frequency and/or amplitude mask in the stretcher portion of the CPA system, one can control and tailor the temporal profile of the laser pulse. By using a liquid crystal array mask or an acoustoptic modulator in the stretcher, one can employ a real time" feedback control system on the pulse train profile. These techniques are ideal for producing, tailoring, and controlling the optimized pulse trains required by the RLPA. Hence, CPA systems with liquid crystal masks provide a very compact, inexpensive driver for the RLPA.

The method and apparatus of the invention can accelerate electrons to high energies with ultrahigh gradient electric fields, produced by table top lasers. Either the electrons themselves, or high energy x-ray light (million electron Volts—billion electron Volts) into which the electron energy may be converted, have numerous industrial, medical, and scientific applications. These applications include:

lithography, spectroscopy, metallurgy, radiography, and sterilization. The device used to accelerate the electrons attaches to existing commercial laser technology. These compact accelerators will be cost efficient, providing higher peak energies at a reduced cost. The electrons or the x-rays are also precisely synchronized with the laser light pulse that produced them.

While this invention has been described in terms of certain embodiments thereof, it is not intended that it be limited to the above description, but rather only to the extent set forth in the following claims.

The embodiments of the invention in which an exclusive property or privilege is claimed are defined in the following claims.

We claim:

1. A method for generating a plasma wave comprising the steps of:

a. generating a series of optical pulses while varying at least one pulse characteristic selected from among pulse width, interpulse spacing, and pulse intensity profile;

b. generating a plasma; and c. resonantly exciting a plasma wave in said plasma by imparting energy from said optical pulses to said plasma wave while said at least one characteristic is varied and changes as the axial electric field amplitude of said plasma wave changes.

2. The method according to claim 1 wherein said plasma of step (b) has a substantially constant profile over a desired length not less than the extent of the Raleigh range, defined as the length over which the spot size of a focused laser beam increases by a factor of $\sqrt{2}$ in vacuum.

3. The method according to claim 1 wherein said pulse width is varied inversely with the axial electric field amplitude of said plasma wave whereby pulse width decreases with increasing electric field amplitude.

4. A method according to claim 1 wherein the interpulse spacing is varied proportionally with the axial electric field amplitude of said plasma wave whereby interpulse spacing increases with increasing amplitude of the electric field.

5. The method according to claim 1 wherein the series of optical pulses is optimized by varying the interpulse spacing, defined as the distance between pulses, for said series of pulses while generating said pulses with equal pulse widths and intensities.

6. The method according to claim 1 wherein the series of optical pulses is optimized by varying the interpulse spacing and pulse width of each pulse for said series of pulses while generating said pulses with equal intensities.

7. The method according to claim 1 wherein the series of optical pulses is optimized by varying the interpulse spacing, the pulse width, and the pulse intensity profile of each pulse within the series of pulses.

8. The method according to claim 1 and further including generating a series of groups of charged particles defined as particle bunches, and injecting said particle bunches into the plasma wave to accelerate said particles.

9. The method according to claim 8 wherein said particle bunches are generated at energies less than or up to about 50 MeV.

10. The method according to claim 8 wherein the particles of said groups (bunches) are electrons which are injected into regions of the plasma wave where the axial electric field of the plasma wave is negative.

11. The method according to claim 8 wherein the particles of said groups (bunches) are positrons which are injected into regions of the plasma wave where the axial electric field of the plasma wave is positive.

12. The method according to claim 8 wherein the particles of said groups (bunches) are electrons which are injected into regions of the plasma wave where the axial electric field of the plasma wave is negative and the radial electric field of the plasma wave is positive.

13. The method according to claim 8 wherein the particles of said groups (bunches) are positrons which are injected into regions of the plasma wave where the axial electric field of the plasma wave is positive and the radial electric field of the plasma wave is negative.

14. The method according to claim 1 which further comprises transporting the series of pulses to the plasma and through the plasma over the extent of the plasma wave acceleration in said plasma.

15. The method according to claim 1 where the pulse width $\tau$ is no greater than the length of the resonance region ($L_{res}$) of the plasma wave, where $L_{res}$ is the length of the phase region of the plasma wave where the electrostatic potential is negative and the axial electric field is positive.

16. The method according to claim 1 wherein each of the pulses has a finite rise time, and pulse width of the $n^{th}$ pulse is no greater than the length of the resonance region of the plasma wave generated by the preceding (n−1) pulse; said region being between $\phi$ (phi) less than zero ($\phi<0$) and the derivative of $\phi$ (phi) with respect to $\zeta$ (zeta) greater than zero ($d\phi/d\zeta>0$), where $\phi$ (phi) is the normalized electrostatic potential of the plasma wake comprising the plasma waves; and $\zeta$ (zeta) is $\zeta=v_g t-z$, where $v_g$ is the group velocity of the laser pulse, t is time, and z is the axial propagation distance.

17. A method for driving a plasma wave comprising: imparting energy from a laser pulse to a plasma wave within a resonance region of the plasma wave where the derivatives of $\phi$ (phi) with respect to $\zeta$ (zeta) is greater than zero ($d\phi/d\zeta>0$); where $\phi$ (phi) is the normalized electrostatic potential of the plasma wave; and $\zeta$ (zeta) is $\zeta=v_g t-z$, where $v_g$ is the group velocity of the laser pulse, t is time, and z is the axial propagation distance.

18. The method according to claims 16 or 17 wherein $\phi$ is related to the axial electric field ($E_x$) by $E_x/E_0=(d\phi/d\zeta)k_p$, where $E_0=m_e c^2 k_p/e$ is the nonrelativistic wave breaking field, $k_p=w_p/c$, and $w_p$ is the electron plasma frequency.

19. The method according to claim 1 and further including measuring the size of said plasma wave amplitude; adjusting said one or more characteristics of said series of optical pulses; remeasuring said plasma wave amplitude; and readjusting said one or more characteristics according to the change in said plasma wave amplitude, to synchronize said pulses with said plasma wave whereby said amplitude is maximized.

20. The method according to claim 8 and further including measuring a change in the acceleration of said charged particles injected as particle bunches into said plasma wave, adjusting said one or more characteristics of said series of optical pulses; remeasuring said charged particle acceleration; and readjusting said one or more characteristics according to the change in said acceleration to synchronize said pulses with said accelerated particles whereby said acceleration is maximized.

21. An apparatus for accelerating charged particles comprising:

a. means for generating a series of optical pulses including means to vary at least one pulse characteristic selected from among pulse width, interpulse spacing, and pulse intensity profile;

b. means for generating a series of charged particle groups (bunches) suitable for injection into a plasma wave for acceleration of said particle groups;

c. means for generating a plasma; and d. means for accelerating said particles including means for injecting said particle groups (bunches) into selected phase regions of said plasma wave in said plasma.

22. The apparatus according to claim 21 and further including means for transporting said series of optical pulses from said pulse generating means to and through said plasma.

23. The apparatus according to claim 21 and further including means for transporting said series of particle groups from said particle group generating means to and through said plasma.

24. The apparatus according to claim 21 wherein said means to generate the optical pulses comprises a chirped pulse amplification (CPA) system.

25. The apparatus according to claim 24 wherein said CPA system comprises means to stretch each of said pulses in time and means to vary the index of refraction of selected regions of said pulses.

26. The apparatus according to claim 24 wherein said CPA system comprises means to stretch each of said pulses in time and means to vary the amplitude of selected regions of said pulses.

27. The apparatus according to claim 24 wherein said CPA system comprises means for generating an optical pulse, means for stretching the pulse in time, means for amplifying the time stretched pulse, and means for recompressing the amplified pulse providing high power pulses of at least 1 terawatt and having a pulse duration of less than a nanosecond.

28. The apparatus according to claim 24 wherein said CPA system further comprises means to split the stretched and amplified pulse into a plurality of beams, defined as delay lines, and a plurality of compressors for recompressing each of the beams (lines) to a desired time duration.

29. The apparatus of claim 21 wherein said means for generating a series of particle bunches is a radio frequency linear accelerator (RF-LINAC).

30. The apparatus according to claim 29 wherein said RF-LINAC comprises a laser photo-cathode.

31. The apparatus according to claim 21 wherein said means for generating the plasma comprises laser photo-ionization means and a gas suitable to be ionized.

32. The apparatus of claim 31 wherein said photo-ionization means comprises a solid state laser with an intensity in excess of $10^{12}$ W/cm$^2$.

33. The apparatus of claim 31 wherein said gas is contained in a back-filled gas chamber at an appropriate density such that the plasma is resonant with the series of optical pulses.

34. The apparatus of claim 31 wherein said gas is emitted from a series of gas jets.

35. The apparatus of claim 31 wherein said gas is selected from the group consisting of hydrogen and helium.

36. The apparatus of claim 21 wherein said means for generating a plasma comprises a laser for producing a plasma density channel which extends axially over at least a portion of the extent of said plasma wave acceleration.

37. The apparatus of claim 36 wherein said laser produces a beam of pulses having an energy in a range of about 1 to about 50 MeV.

38. The apparatus according to claim 21 wherein the means to generate the optical pulses comprises a zero dispersion stretcher system.

39. The apparatus of claim 22 wherein said means for transporting the series of optical pulses comprises a series of optical lenses and mirrors.

40. The apparatus of claim 22 wherein said means for transporting the series of optical pulses comprises pulse propagation through a desired plasma density channel.

41. The apparatus according to claim 22 wherein said means for transporting the series of optical pulses comprises relativistic self focusing within said plasma.

42. The apparatus of claim 23 wherein said means for transporting the series of particle bunches comprises a series of magnetic fields and magnetic lenses.

43. The apparatus of claim 42 wherein said magnetic fields and magnetic lenses comprise solenoidal and/or quadrapole magnets.

44. The apparatus of claim 23 wherein said means for transporting the series of charged particle bunches comprises a radial electric field of said plasma wave.

45. The apparatus of claim 25 wherein the means to vary the index comprises a mask having a liquid crystal array.

46. The apparatus of claim 26 wherein the means to vary the amplitude comprises a mask having a liquid crystal array.

47. The apparatus according to claim 21 and further including means to measure the size of the axial electric field amplitude of said plasma wave and means for adjusting said one or more characteristics of said series of optical pulses to synchronize said pulses with said plasma wave as said amplitude changes.

48. The apparatus according to claim 47 wherein said means to measure said plasma wave axial electric field amplitude is an optical probe.

49. The apparatus according to claim 21 and further including means to measure the acceleration of said particles and means to adjust said one or more characteristics of said optical pulses to synchronize said pulses with said particles as said acceleration changes.

* * * * *